US012661544B2

(12) United States Patent
Mickolio et al.

(10) Patent No.: US 12,661,544 B2
(45) Date of Patent: Jun. 23, 2026

(54) SHOULDER STRENGTHENING SYSTEMS

(71) Applicant: Titin KM Biomedical Corp., Mesa, AZ (US)

(72) Inventors: Kole Mickolio, Billings, MT (US); Kameron Mickolio, Mesa, AZ (US); Rory Maughan, Bozeman, MT (US); Seth Meyer, Bozeman, MT (US)

(73) Assignee: Titin KM Biomedical Corp., Bozeman, MT (US)

( * ) Notice: Subject to any disclaimer, the term of this patent is extended or adjusted under 35 U.S.C. 154(b) by 122 days.

(21) Appl. No.: 18/471,038

(22) Filed: Sep. 20, 2023

(65) Prior Publication Data

US 2024/0024725 A1 Jan. 25, 2024

Related U.S. Application Data

(63) Continuation of application No. PCT/US2022/023150, filed on Apr. 1, 2022.
(Continued)

(51) Int. Cl.
*A63B 21/008* (2006.01)
*A63B 21/00* (2006.01)
*A63B 23/12* (2006.01)

(52) U.S. Cl.
CPC ..... *A63B 21/008* (2013.01); *A63B 21/00069* (2013.01); *A63B 21/4021* (2015.10);
(Continued)

(58) Field of Classification Search
CPC ..... A63B 21/008; A63B 21/4021; A63B 21/4035; A63B 21/4045; A63B 21/4047;
(Continued)

(56) References Cited

U.S. PATENT DOCUMENTS 3,428,311 A 2/1969 Mitchell
4,249,727 A 2/1981 Dehan
(Continued)

FOREIGN PATENT DOCUMENTS

AU 653426 9/1994
EP 1520605 4/2005
(Continued)

OTHER PUBLICATIONS

International Search Report and Written Opinion dated Jul. 5, 2022, from International Patent Application No. PCT/US2022/023150, 8 pp.
(Continued)

*Primary Examiner* — Zachary T Moore
(74) *Attorney, Agent, or Firm* — Klarquist Sparkman, LLP

(57) ABSTRACT

Shoulder strengthening systems can provide multidirectional and dynamic resistance to shoulder movement of a user. A shoulder strengthening system can include a frame, a joint pivotably coupled to the frame, a resistance mechanism coupled to the joint, and a shaft coupled to the joint. Resistance mechanisms can include a first hydraulic member and a second hydraulic member. The first hydraulic member can be configured to restrict relative motion of the joint about a first axis and the second hydraulic member can be configured to restrict relative motion of the joint about a second axis. The shaft and the joint of a shoulder strengthening system can be configured to move together relative to the frame about the first and second axes.

20 Claims, 14 Drawing Sheets

Related U.S. Application Data

(60) Provisional application No. 63/277,071, filed on Nov. 8, 2021, provisional application No. 63/170,372, filed on Apr. 2, 2021.

(52) U.S. Cl.
CPC ..... *A63B 21/4035* (2015.10); *A63B 21/4045* (2015.10); *A63B 21/4047* (2015.10); *A63B 23/1245* (2013.01); *A63B 2220/16* (2013.01); *A63B 2220/833* (2013.01)

(58) Field of Classification Search
CPC ..... A63B 21/00069; A63B 23/1245; A63B 2220/16; A63B 2220/833
See application file for complete search history.

(56) References Cited

U.S. PATENT DOCUMENTS

| | | | | |
|---|---|---|---|---|
| 4,629,182 | A | 12/1986 | Rader et al. | |
| 4,629,185 | A * | 12/1986 | Amann | A63B 21/0083 482/133 |
| 4,872,668 | A | 10/1989 | McGillis et al. | |
| 5,013,034 | A | 5/1991 | March et al. | |
| 5,058,887 | A | 10/1991 | Patterson | |
| 5,178,160 | A | 1/1993 | Gracovetsky et al. | |
| 5,244,444 | A | 9/1993 | Wostry | |
| 5,755,645 | A | 5/1998 | Miller et al. | |
| 6,676,570 | B2 | 1/2004 | Valentino | |
| 7,115,078 | B1 * | 10/2006 | Kalember | A63B 21/4035 482/133 |
| 8,360,935 | B2 | 1/2013 | Olsen et al. | |
| 8,636,630 | B2 * | 1/2014 | Morris | A63B 23/1209 482/117 |
| 9,861,856 | B1 | 1/2018 | Miller et al. | |
| 10,022,578 | B2 | 7/2018 | Kelly | |
| 10,159,871 | B2 | 12/2018 | Miller et al. | |
| 10,357,678 | B2 | 7/2019 | Brown | |
| 10,427,000 | B1 | 10/2019 | Miller et al. | |
| 10,449,413 | B2 | 10/2019 | Goldston et al. | |
| 10,888,732 | B2 | 1/2021 | Miller et al. | |
| 11,103,751 | B2 | 8/2021 | Miller et al. | |
| 12,011,639 | B2 | 6/2024 | Miller et al. | |
| 2003/0013586 | A1 | 1/2003 | Rothschild | |
| 2007/0066918 | A1 * | 3/2007 | Dewald | A63B 21/00178 482/901 |
| 2007/0184941 | A1 | 8/2007 | Krietzman | |
| 2008/0234116 | A1 | 9/2008 | Elzerman | |
| 2011/0300994 | A1 | 12/2011 | Verkaaik et al. | |
| 2012/0109025 | A1 | 5/2012 | Weinberg et al. | |
| 2013/0338547 | A1 | 12/2013 | Shimizuhira et al. | |
| 2017/0132947 | A1 | 5/2017 | Maeda et al. | |
| 2021/0291010 | A1 | 9/2021 | Miller et al. | |
| 2021/0387055 | A1 | 12/2021 | Miller et al. | |
| 2022/0143455 | A1 | 5/2022 | Miller et al. | |
| 2023/0226406 | A1 | 7/2023 | Mickolio | |
| 2024/0123289 | A1 | 4/2024 | Miller et al. | |

FOREIGN PATENT DOCUMENTS

| | | |
|---|---|---|
| JP | 2007-050249 | 3/2007 |
| WO | WO 85/01446 | 4/1985 |
| WO | WO 96/12528 | 5/1996 |
| WO | WO 2004/073804 | 9/2004 |
| WO | WO 2005/074373 | 2/2005 |
| WO | WO 2005/032663 | 4/2005 |
| WO | WO 2021/188780 | 9/2021 |
| WO | WO 2022/104312 | 5/2022 |
| WO | WO 2022/212904 | 10/2022 |

OTHER PUBLICATIONS

Supplementary European Search Report dated Jan. 23, 2025, from European Patent Application No. 22782330.9, 9 pp.
International Search Report and Written Opinion dated Jan. 27, 2023, from International Patent Application No. PCT/US2022/045755, 9 pp.
Extended European Search Report dated Oct. 16, 2025, from European Patent Application No. 22890595.6, 9 pp.
Notice of Reasons for Refusal dated Jan. 23, 2026, from Japanese Patent Application No. 2023-560393, 8 pp.

* cited by examiner

SHOULDER STRENGTHENING SYSTEMS

CROSS-REFERENCED TO RELATED APPLICATIONS

This application is a continuation of International Application No. PCT/US2022/023150, filed Apr. 1, 2022, which in turn claims the benefit of U.S. Provisional Application No. 63/277,071, filed Nov. 8, 2021, and U.S. Provisional Application No. 63/170,372, filed Apr. 2, 2021, each of which is incorporated by reference herein in its entirety.

FIELD

The present disclosure relates generally to exercise equipment, and more particularly to exercise equipment for shoulder strengthening.

BACKGROUND

Physical therapy treatment and the exercises used for shoulder strengthening are currently hampered by a lack of dynamic, weight-bearing equipment, that can isolate the shoulder joint in 360 degrees of motion. Because surgical procedures alone are unable to fully repair one's shoulder, physicians and patients are left reliant on conventional exercise equipment for rehabilitation. The existing shortcomings in shoulder rehabilitation, especially post-surgery rehabilitation, are attributable to the limited utility of elastic bands, medicine balls, dumbbells, and other conventional weight-room equipment typically used to strengthen the shoulder. Conventional exercise equipment, for instance, only allow for resistance in one plane of shoulder-joint motion at any one time, such as motion in the coronal plane about an anterior-posterior axis, and motion in the sagittal plane about a medial-lateral axis. A shoulder strengthening system that can address the significant lack of dynamic weight bearing equipment in the current field of physical therapy and shoulder recovery is needed.

SUMMARY

According to an aspect of the disclosed technology, an exercise apparatus can include a frame, a joint pivotably coupled to the frame, a resistance mechanism coupled to the joint, a shaft coupled to the joint, and a wrist-ring structure coupled to the shaft. The shaft, the wrist-ring structure, and the joint can move together relative to the frame, and the resistance mechanism can be configured to restrict movement of the joint relative to the frame.

In another representative embodiment, an exercise apparatus can include a frame, a joint pivotably coupled to the frame, and a resistance mechanism coupled to the joint. The exercise apparatus can also include a first hydraulic member and a second hydraulic member, the first hydraulic member can be configured to restrict relative motion of the joint about a first axis and the second hydraulic member can be configured to restrict relative motion of the joint about a second axis. The exercise apparatus can further include a shaft coupled to the joint and a wrist-ring structure coupled to the shaft. The shaft, the wrist-ring structure, and the joint can be configured to move together relative to the frame about the first and second axes.

In another representative embodiment, an exercise apparatus can include a frame, a joint pivotably coupled to the frame, a resistance mechanism coupled to the joint, a shaft assembly coupled to the joint, and a wrist-ring structure coupled to the shaft assembly. The shaft assembly can include a first member and a second member coaxially aligned with and slidably coupled to the first member. The shaft assembly, the wrist-ring structure, and the joint can move together relative to the frame and the resistance mechanism can be configured to restrict movement of the joint relative to the frame.

In another representative embodiment, an exercise apparatus can include a frame, a joint pivotably coupled to the frame, a resistance mechanism coupled to the joint, a shaft coupled to the joint, and a wrist-ring structure coupled to the shaft. The wrist-ring structure can include a ring, a shuttle movably coupled to the ring, and a brace coupled to the shuttle. The shuttle and brace can be configured to move along a circumference of the ring and about a first axis of the wrist-ring structure. The shaft, the wrist-ring structure, and the joint can move together relative to the frame and the resistance mechanism can be configured to restrict movement of the joint relative to the frame.

In another representative embodiment, an exercise apparatus can include a frame, a joint moveably coupled to the frame, a resistance mechanism coupled to the joint, a shaft coupled to the joint, and a wrist-ring structure coupled to the shaft. The shaft and the wrist-ring structure, and the joint can move together relative to the frame about first, second, and third axes. The resistance mechanism can be configured to restrict movement of the joint relative to the frame.

The foregoing and other objects, features, and advantages of the technology will become more apparent from the following detailed description, which proceeds with reference to the accompanying figures.

DETAILED DESCRIPTION

General Considerations

Figure 1:
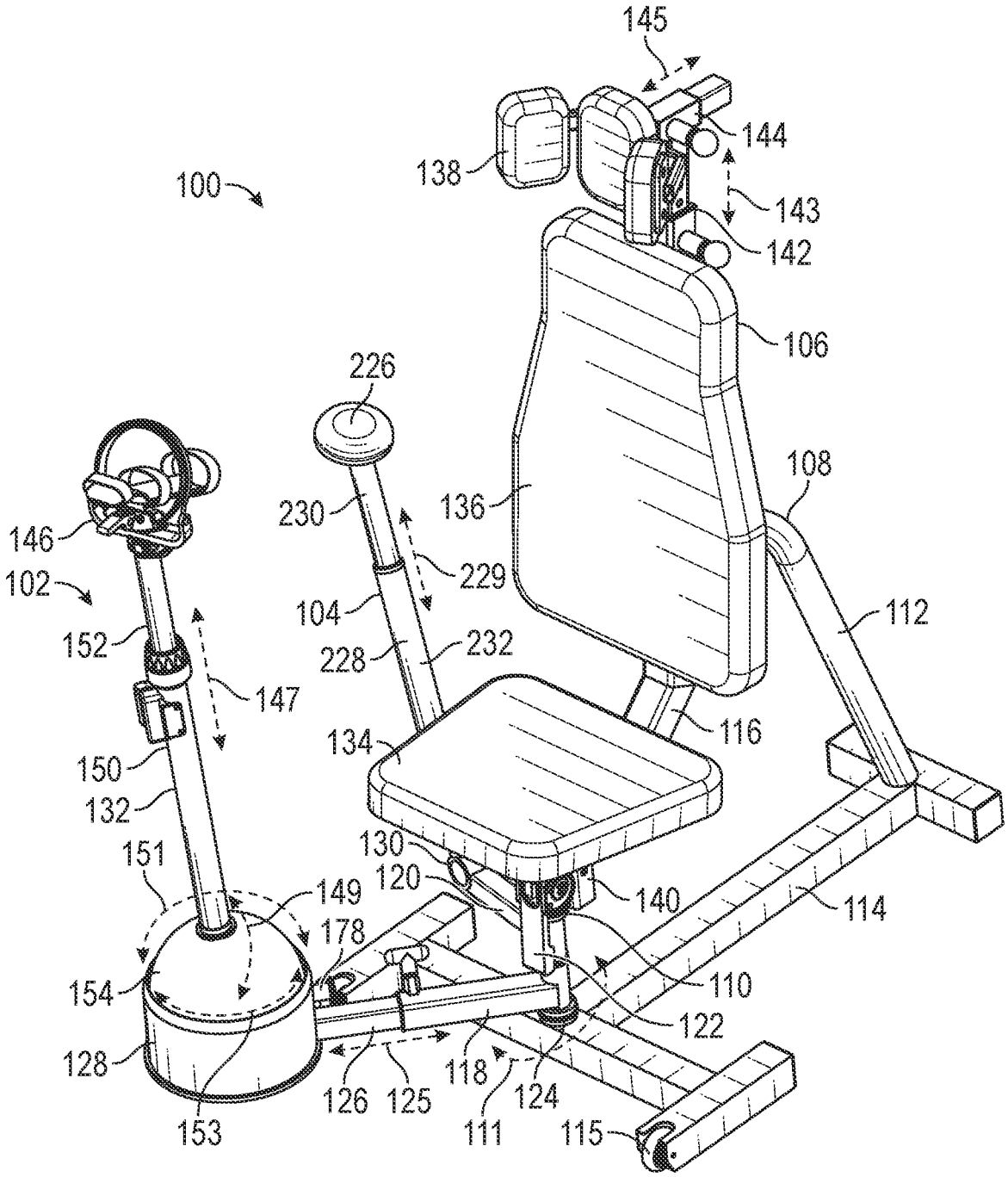
FIG. 1 is a perspective view of a shoulder strengthening system, according to one example.

The systems, apparatus, and methods described herein should not be construed as limiting in any way. Instead, the present disclosure is directed toward all novel and non-obvious features and aspects of the various disclosed examples, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. Any theories of operation are to facilitate explanation, but the disclosed systems, methods, and apparatus are not limited to such theories of operation.

In some examples, values, procedures, or apparatus are referred to as "lowest," "best," "minimum," or the like. It will be appreciated that such descriptions are intended to indicate that a selection among many used functional alternatives can be made, and such selections need not be better, smaller, or otherwise preferable to other selections.

As used in the application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside," "top," "down," "interior," "exterior," and the like. Such terms are used, where applicable, to provide some clarity of description when dealing with relative relationships, particularly with respect to the illustrated examples. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Examples of the Disclosed Technology

There is a growing consensus among physical therapists and medical practitioners that the use of elastic bands and other conventional equipment used for shoulder rehabilitation show a lack of efficacy. The shoulder joint is a ball-in-socket joint that has nearly 360 degrees of motion in multiple planes, making it the most dynamic and unstable joint in the body. Indeed, the most common muscles and joint injuries among athletes and the general population are the various muscles that attach around the shoulder joint as well as the surrounding cartilage and the labrum. For this reason, an exercise system which can advance the current state of available equipment for shoulder rehabilitation is needed.

The shoulder strengthening systems disclosed herein can provide multidirectional and dynamic resistance to shoulder movement of a user. Resistance mechanisms of the shoulder strengthening systems can utilize a hydraulic system to apply a resistive force to a joint and a telescoping shaft coupled to the joint. The shaft can be maneuverable along the full range of motion provided by the joint, but the movement of the shaft can be limited or restricted in all planes of motion by the hydraulic system which can apply variable resistance. A wrist-ring structure at the end of the telescoping shaft can allow a user of the shoulder strengthening system to manipulate the shaft while the resistive force is applied, providing dynamic resistance to the user's shoulder as the user manipulates the shaft. The wrist-ring structure can also be configured to support a user's hand and wrist, while allowing relatively free motion of the wrist when such movement is desired and restricting movement of the wrist when such movement is undesired.

The disclosed shoulder strengthening systems can provide dynamic and seamless motion via the shaft and wrist-ring structures which closely reflects the natural motion of the human arm and shoulder joint. The shoulder joint rarely acts in a vacuum and in a single plane of motion at a time. By having a shoulder strengthening system that can provide resistance at each physiological plane and angle, this will reproduce as closely to physiologically possible, what the shoulder joint experiences during motion, which can provide significant advantages over conventional equipment used in shoulder strengthening and rehabilitation.

Figure 3:
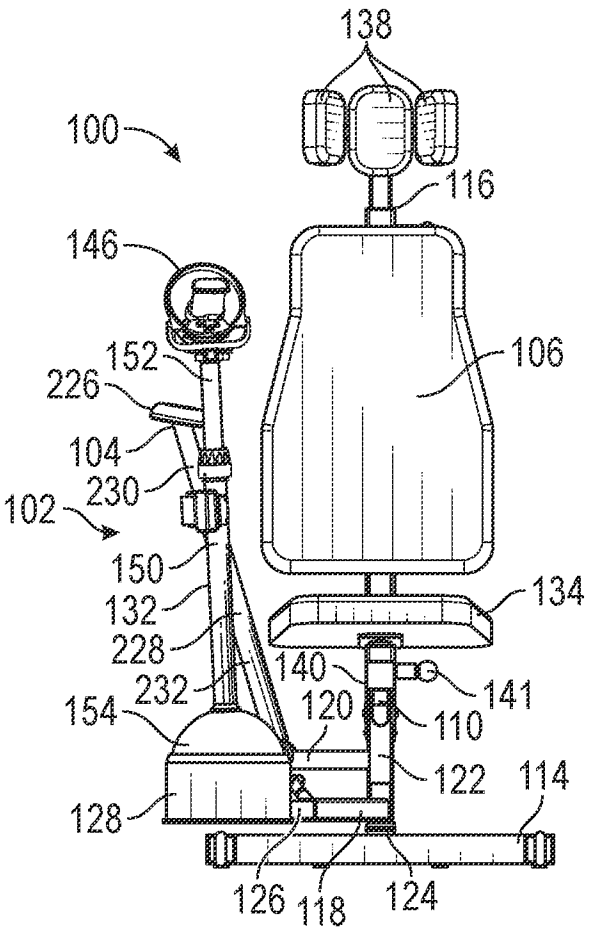
FIG. 3 is a front plan view of the shoulder strengthening system of FIGS. 1-2.
Figure 2:
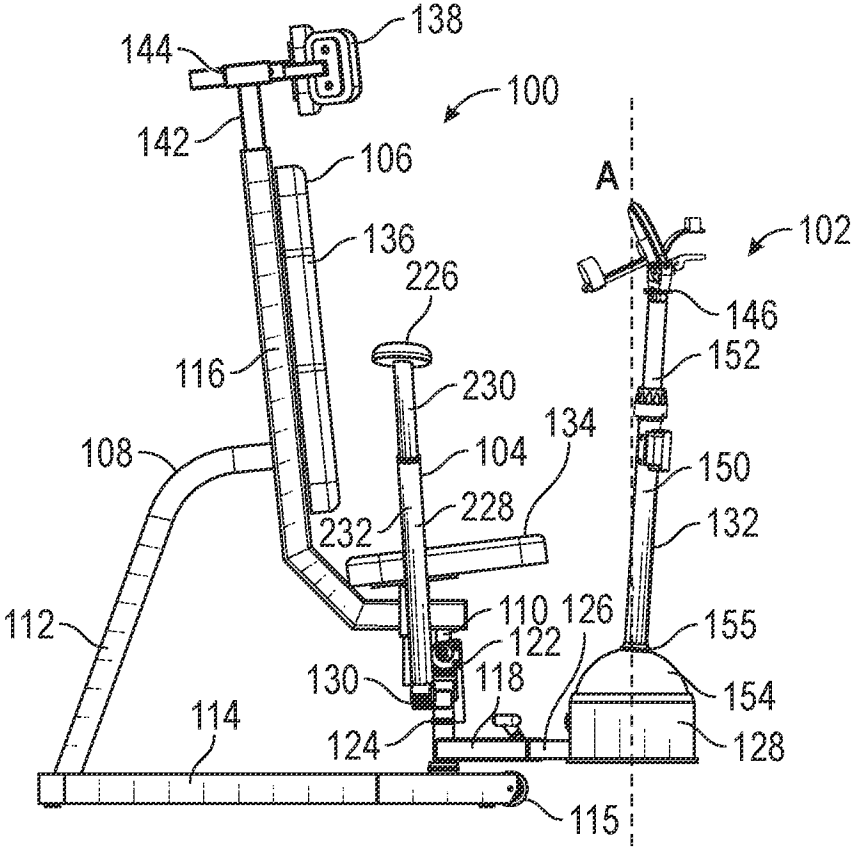
FIG. 2 is a side view of the shoulder strengthening system of FIG. 1.

FIGS. 1-8D depict an exemplary shoulder strengthening system 100 according to one example. As depicted in FIGS. 1-3, the shoulder strengthening system 100 can include a resistance system 102, a support 104, and chair structure 106 mounted to a frame 108. The frame 108 can have a pair of interconnected, upwardly extending posts 110, 112 coupled to the frame's base 114 at the front and rear. The front and rear posts 110, 112 are interconnected by a strut 116. The strut 116 extends from the front post 110 to the rear post 112 and upwardly beyond the upper most end of the rear post 112 to form the backbone of the chair structure 106. The front post 110 can be vertical or substantially vertical relative to the base 114 of the frame 108, while the rear post 112 can extend upwardly at an angle relative to the base 114 and curve toward the strut 116. In some examples, the base 114 includes one or more wheels 115 at the front (FIGS. 1-3) and/or rear of the base 114 configured to allow the shoulder strengthening system 100 to be readily moved from one location to another.

As illustrated in FIGS. 1-3, the resistance system 102 and support 104 are coupled to the front post 110 of the frame 108 via outwardly extending arms 118, 120, respectively. Each arm 118, 120, for instance, is hinged to the front post 110 of the frame 108 and configured to freely rotate (e.g., clockwise and counterclockwise) about the front post 110 and relative to one another, as well as the frame 108 and the chair structure 106. As illustrated in FIG. 1, the arms 118, 120 extend over the first post 110 and are stacked atop one another. For example, the arm 120 coupled to the support 104 is located above and proximate the arm 118 coupled to the resistance system 102. In this way, the arms 118, 120 can be referred to as lower and upper arms, which rotate about the same axis formed by the front post 110. The frame 108 also includes a lever 122 located just above the upper arm 120 and is configured to apply a downward force on the upper arm 120 such that the upper arm 120 applies a downward force on the lower arm 118 and the base 114 of the frame 108. A pair of interlocking washers 124 can be coaxially aligned with the front post 110 and positioned between the lever 122 and the upper arm 120, the lower and upper arms 118, 120, and/or the lower arm 118 and the base 114.

Each washer of a pair of interlocking washers 124 can be coupled to its respective adjacent structure, such as the base 114, lower arm 118, upper arm 120, or the lever 122. For example, one washer can be coupled to the bottom end of the upper arm 120 and another washer can be coupled to the upper end of the lower arm 118. In this arrangement, the arms 118, 120 and thereby both the resistance system 102 and support 104 can be locked into a desired position relative to the chair structure 106 and one another when the lever 122 applies a downward force on the arms 118, 120. By way of example, when the lever 122 is in a first position (e.g., in a downward direction; FIGS. 1-3) the lever 122 exerts downward pressure to the upper and lower arms 120, 118. The downward pressure acting on the arms 118, 120 causes the interlocking washers 124 to mate and interlock to prevent the rotation of the lower and upper arms 118, 120 and lock them into a desired position. Inversely, when the lever 122 is in a second position (e.g., directed in an outward direction) the lower and upper arms 118, 120 are free to rotate about the front post 110. In this configuration, the arms 118, 120, and therefore the resistance system 102 and support 104, are configured to rotate 360 degrees about the front post 110, as indicated by arrow 111, but can be placed and locked into a variety of desired positions.

In some examples, the arms 118, 120 can be positioned in an opposite arrangement. For instance, the arm 120 coupled to the support 104 can be stacked below the arm 118 coupled to the resistance system 102 such that the arm 120 is a lower arm and the arm 118 is an upper arm. In still further examples, each washer of each pair of washers 124 can include teeth or ridges which are configured to mate and interlock with a corresponding washer such that movement of the arms are restricted when pressure applied by the lever forces the pair of washers to contact one another.

As shown in FIGS. 1-3, the lower arm 118 can be configured as one half of an adjustable assembly. The lower arm 118 can be configured, for instance, to receive a corresponding slidable structure 126 of the adjustable assembly extending outwardly from a base 128 of the resistance system 102. In this way, the resistance system 102 can be positioned at varied lengths or distances relative to the front post 110 of the frame 108 and the chair structure 106, as indicated by arrows 125 (FIG. 1). A clamping screw, for example, can be operable to engage and release the slidable structure 126 of the resistance system 102. This, for instance, allows the distance between the base 128 and the front post 110 to be increased and decreased, thereby rendering the position of the resistance system 102 adjustable relative to the chair structure 106. In other examples, however, the lower arm 118 and/or corresponding structure of the resistance system 102 can be configured in a variety of ways, including various adjustable assemblies and systems, which allow the resistance system 102 and its base 128 to be positioned relative to the chair structure 106.

As illustrated in FIG. 1, the support 104 and upper arm 120 can be coupled in such a way as to allow the support 104 to be positioned in a variety of different orientations relative to the chair structure 106. For instance, the upper arm 120 and support 104 can be coupled by way of a pivotable joint 130 such that the support 104, and a shaft 228 thereof, can pivot relative to the upper arm 120, including toward and away from the chair structure 106. In this way, the support 104 can also be adjustable relative to the chair structure 106 and the other components of the shoulder strengthening system 100. In some examples, the upper arm 120 can also be configured as an adjustable assembly such that the distance between the front post 110 and the joint 130 can also be adjustable. For example, this can be achieved in a similar fashion as the adjustable assembly configured to adjust the relative distance between the resistance system 102 and the front post 110. In still further examples, a portion of the upper arm 120 can be configured to rotate from side-to-side such that the support 104 can move in a clockwise and counterclockwise direction relative to the upper arm 120, such as in a frontward and rearward direction (e.g., clockwise and counterclockwise in a vertical plane parallel to the chair structure 106).

Referring to FIGS. 1-3, the chair structure 106 coupled to the frame 108 can include a seat 134, a backrest 136, and a headrest 138, each of which can be formed of padded structure. As depicted in the illustrated examples, the seat 134 and headrest 138 can each be adjustable to accommodate the height and size of a user seated in the chair structure 106. The seat 134, for instance, can be coupled to the strut 116 via a pull-pin adjustable assembly 140 (FIGS. 1 and 3), permitting the seat 134 to be adjusted upward and downward relative to the base 114 of the frame 108 via a pin 141 (FIG. 3). The pin 141 (e.g., a T-handle pin, spring-loaded pin, clamping screw, etc.) can be operable to engage and release the slidable structure of the seat 134, such as by mating the pin with one or more apertures along the surface of the slidable structure. Similarly, the headrest 138 can be adjusted upward and downward, as indicated by arrows 143, relative to the backrest 136 and seat 134 via a pull-pin adjustable assembly 142. The pull-pin adjustable assembly 142 in this instance, can be integrated in combination with the upper end of the strut 116 (e.g., the strut 116 can receive a slidable portion of the assembly). Moreover, the headrest 138 can be adjusted frontward and rearward, as indicated by arrows 145, via a pull-pin adjustable assembly 144 (FIGS. 1-2).

As illustrated in FIGS. 1 and 3, the headrest 138 includes three padded structures, the first padded structure being oriented similarly to the backrest 136, while the other two padded structures are angled outwardly relative to the first. In this curved-like arrangement, the headrest 138 is configured to provide stability and support to the neck and head of a user seated in the chair structure 106. Providing support and stability through limiting rearward motion of the head and neck for example. The two angled, outer padded structures, in some examples, can also act to limit lateral movement of the head to help the user seated in the shoulder strengthening system 100 to maintain a desired posture, such as in maintaining proper alignment of the head, neck, and spine. Maintaining alignment of the head, neck, and spine can encourage focused engagement of the user's arm, shoulder, and/or those portions of the anatomy surrounding the shoulder joint (e.g., surrounding muscle tissue). In other words, maintaining alignment can limit a user's engagement of the anatomy outside of the shoulder area (e.g., hips, lower back, etc.), which can otherwise detract from the focused and isolated movement of exercises directed to shoulder strengthening. Nonetheless, the headrest 138 can be configured to allow any body movement of the user, if desired. Although, the headrest 138 is described herein as including three padded structures, in other examples, the headrest 138 can include any fewer or greater number of padded structures.

In addition to, or in lieu of, using the outer padded structures of the headrest 138 to help the user seated at the shoulder strengthening system 100 to maintain a desired posture, the chair structure 106 can also include one or more fasteners (not shown) configured to restrict movement of the head, torso, and/or legs. For instance, the backrest 136 and/or headrest 138 can include a strap which extends across the corresponding anatomy of the user to reduce or prevent forward and/or lateral movement of the torso and/or head relative to the chair structure 106 while in use. Similarly, the seat 134 can include a strap to extend across the legs of the user seated, to reduce or prevent upward movement and/or maintain leg spacing and alignment relative to the user's hips.

Though the frame 108, chair structure 106, arms 118, 120, and their respective components, are described and depicted with particularity, it should be appreciated that these features can be constructed and/or arranged in a number of different ways in accordance with the functionality and principles described herein. As one example, the arms 118, 120 need not be stacked atop each other or coupled to the same element of the frame, but rather can be spaced from one another along the base, and pivot and/or rotate about separate axes.

Still referring to FIGS. 1-3, the resistance system 102 can include a base 128, a shaft 132 coupled to the base 128 via a pivotable joint 156 (FIG. 4), and a wrist-ring structure 146 coupled to the shaft 132. The resistance system 102 can also include a resistance mechanism 148 (FIG. 4) configured to restrict movement of the shaft 132 and the wrist-ring structure 146 relative to the base 128. The base 128 can form a housing and structural support for the pivotable joint 156 and resistance mechanism 148. The base 128 can also include the outwardly-extending slidable structure 126 received by the lower arm 118 that forms one half of the corresponding adjustable assembly. In this configuration, and as mentioned previously, the resistance system 102 and the components thereof, can be adjusted relative to and rotate about an axis formed by the front post 110, and be secured in a desired position via the lever 122 and interlocking washers 124.

As depicted in FIG. 2, the base 128 can include a central longitudinal axis A extending upwardly from the base 128. The longitudinal axis A can be perpendicular to the bottom surface of the base 128 or a ground surface on which the shoulder strengthening system 100 is located. The longitudinal axis A can also define an origin in which movement of the other components of the resistance system 102, including the shaft 132 and wrist-ring structure 146, can be described. For instance, movement of the individual or collective components of the resistance system 102 can be described relative to the longitudinal axis A.

Figure 7B:
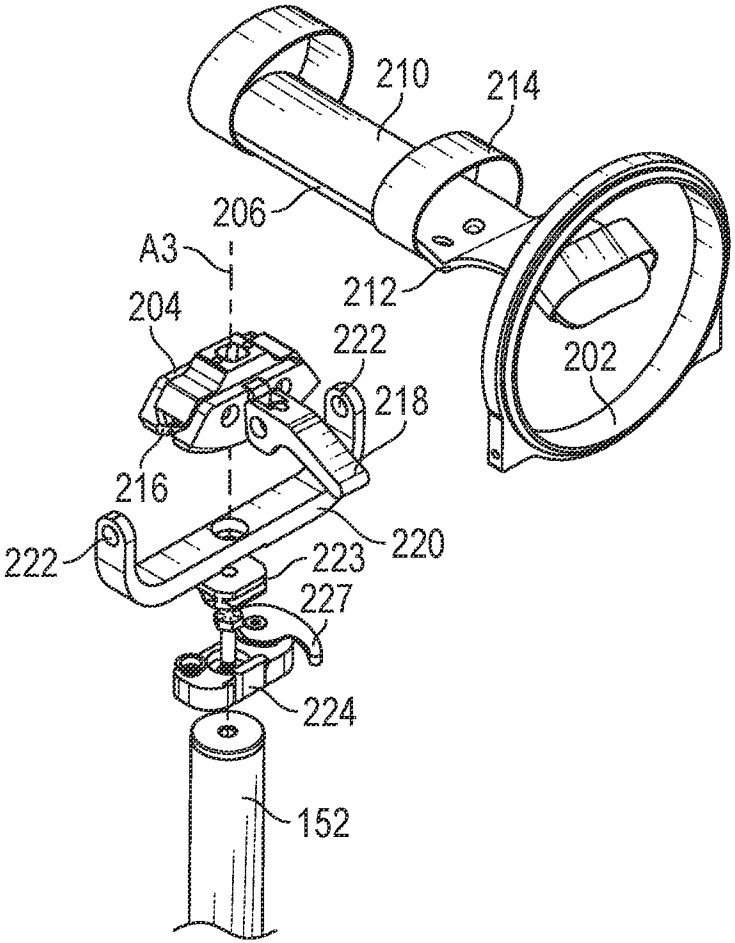
FIG. 7B is an exploded view of the wrist-ring structure of FIG. 7A.
Figure 7A:
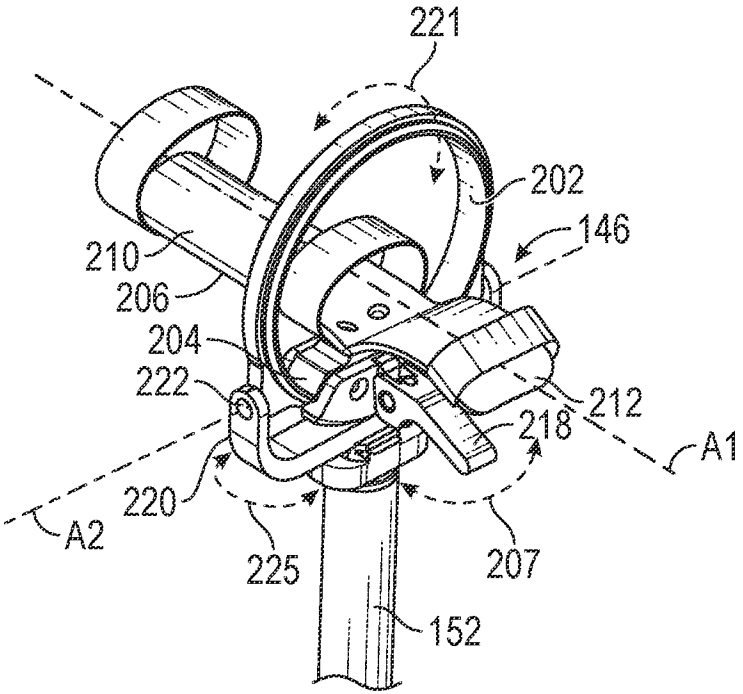
FIG. 7A is a perspective view of a wrist-ring structure of the shoulder strengthening system of FIGS. 1-3.
Figure 8A:
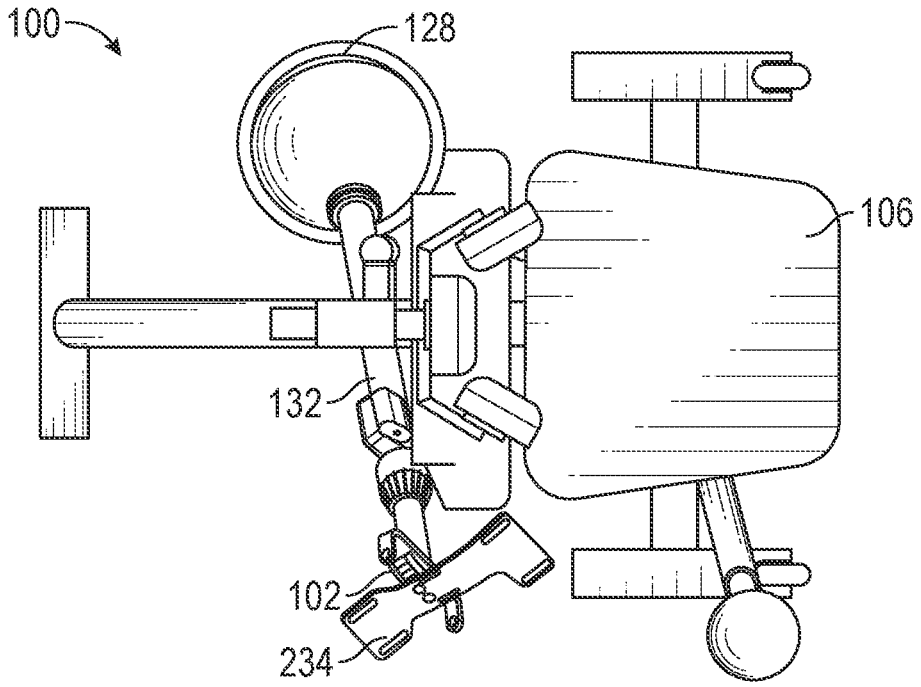
FIG. 8A is a top-down view of the shoulder strengthening system, according to a second configuration.
Figure 8B:
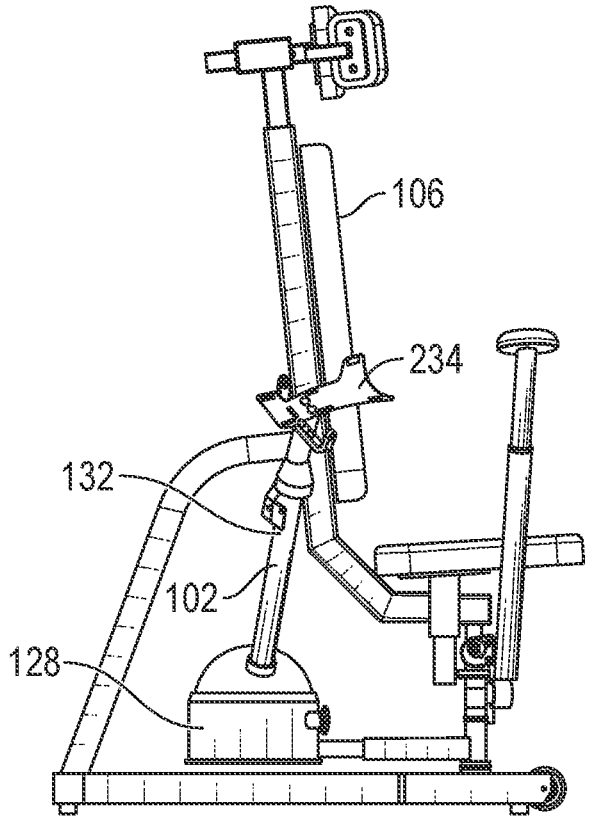
FIG. 8B is a side view of the shoulder strengthening system of FIG. 8A.
Figure 8C:
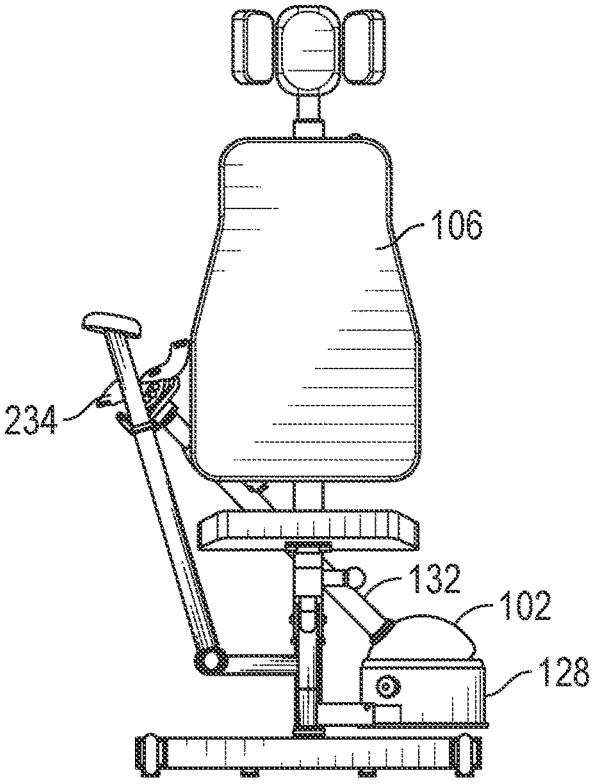
FIG. 8C is a front plan view of the shoulder strengthening system of FIGS. 8A-8B.
Figure 8D:
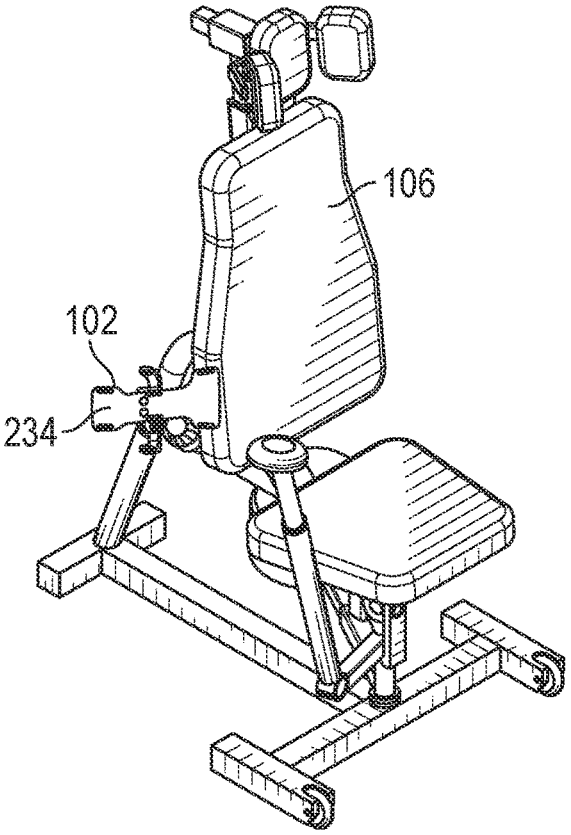
FIG. 8D is a perspective view of the shoulder strengthening system of FIGS. 8A-8C.

As shown in FIGS. 1-3, the shaft 132 can include an outer, first member 150 and an inner, second member 152 which can be slidably coupled to the first member 150, as generally indicated by arrows 147. The first member 150 can be coupled to the universal joint 156 (FIG. 4), and a cover 154 (e.g., via a nut 155 in FIG. 4) that encloses the universal joint 156 and resistance mechanism 148 within the body of the base 128. The upper end of the second member 152 can be coupled to the wrist-ring structure 146. The wrist-ring structure 146 can be configured to brace the wrist and thereby the arm and hand of a user and permit the wrist to rotate and pivot about multiple axes (FIGS. 7A-7B). The wrist-ring structure 146 can also be configured to restrict or limit certain wrist movement, such as when certain wrist or arm movement is undesirable for a given exercise. As described herein, the shaft 132 and wrist-ring structure 146 are capable of multidirectional movement relative to the longitudinal axis A and base 128 via the operation of the universal joint 156. This multidirectional movement is generally indicated, for example, by arrows 149, arrows 151, and arrows 153 (FIG. 1). The resistance mechanism 148 can be operable to apply a resistive force to the universal joint 156 to restrict the movement of the shaft 132 and wrist-ring structure 146 relative to the base 128 and chair structure 106 (e.g., the longitudinal axis A) as a user manipulates the shaft 132 and wrist-ring structure 146 along the range of motion provided by the joint 156.

Figure 4:
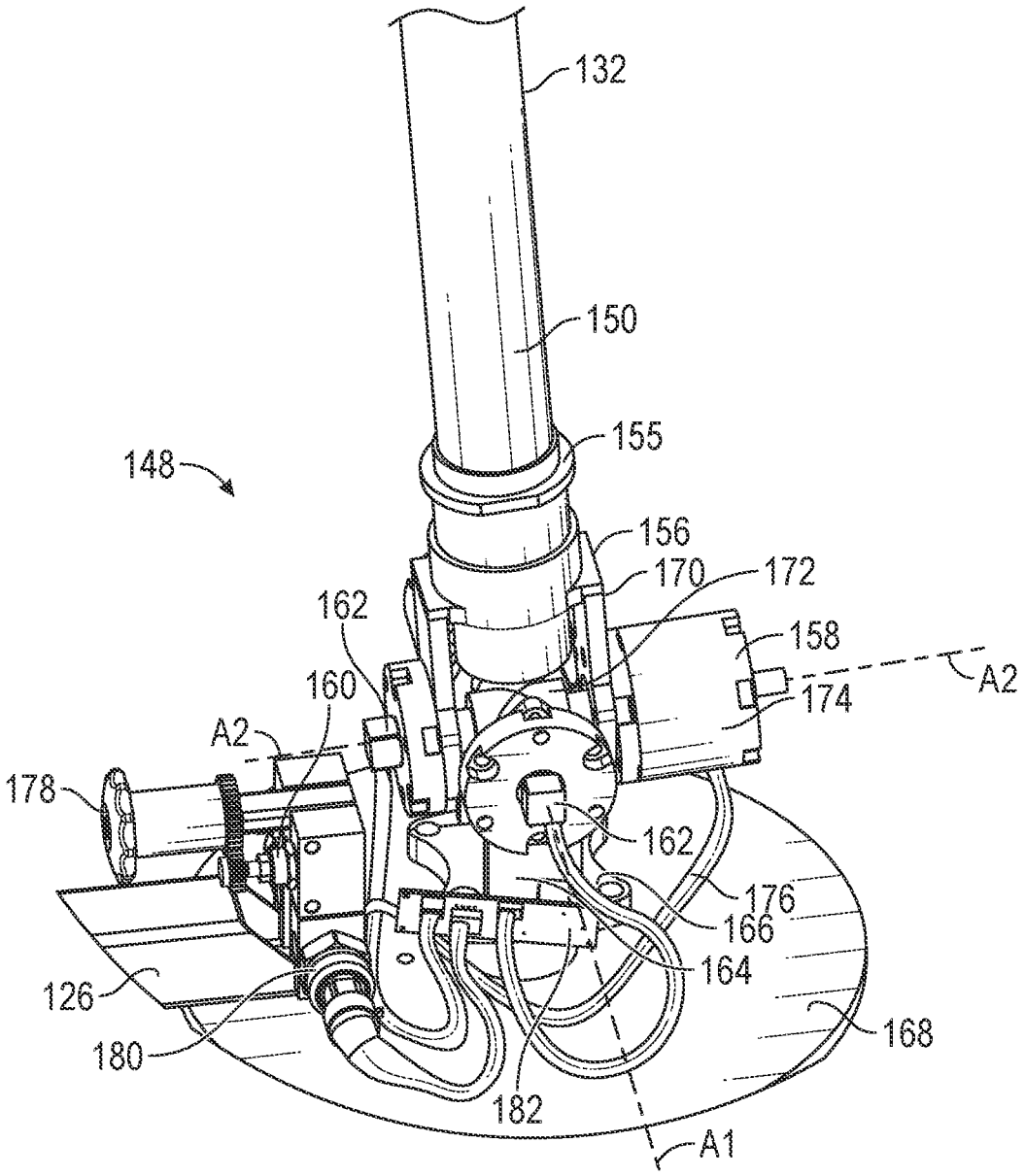
FIG. 4 is a perspective view of a resistance mechanism according to one example.

FIG. 4 depicts the universal joint 156 and resistance mechanism 148 enclosed within the base 128 and cover 154 according to one example. As illustrated in FIG. 4, the shaft 132 and the resistance mechanism 148, which can include a pair of hydraulic members 158, one or more variable flow valves 160, and one or more sensors 162, can be coupled to the universal joint 156. The universal joint 156 can include a first fork or yoke 164 integrated with a bracket 166 and coupled to a base plate 168 (e.g., bolted, screwed, welded, etc.). The base plate 168, for instance, can form the bottom surface of the base 128 and/or be coupled to the slidable structure 126 which extends through and outwardly from the base 128 to mate with the lower arm 118. In some examples, the base plate 168 can be situated within the base 128. In this configuration, the universal joint 156 can be said to be coupled to the frame 108 of the shoulder strengthening system 100.

The universal joint 156 can also include a second fork or yoke 170 coupled to the first member 150 of the shaft 132 and the first yoke 164 of the joint via a spider or cross 172. In this configuration, the first yoke 164 and cross 172 form a first pivot axis A1, while the second yoke 170 and the cross 172 form a second pivot axis A2 perpendicular to the first pivot axis A1. In some examples, the cross 172 can be constructed of one or more components and/or can be configured to prevent or allow the shaft 132 to extend therethrough (e.g., as shown in FIGS. 4 and 5A, respectively).

The configuration of the universal joint 156 can allow the shaft 132 to move or pivot relative to the base 128 and about the longitudinal axis A (FIG. 2) in multiples directions and planes of motion. As an example, via its coupling to the universal joint 156, the shaft 132 is configured to freely move 360 degrees in both clockwise and counterclockwise directions about the longitudinal axis A (e.g., looking down or up the axis A). The universal joint 156 also allows the shaft 132 and wrist-ring structure 146 to be positioned in alignment with and at various angles relative to the longitudinal axis A. For example, the shaft 132 can be aligned with and moved in any direction away from the longitudinal axis A such that the shaft 132 forms an angle relative to the longitudinal axis A (e.g., the slight angle the shaft 132 forms with longitudinal axis A in FIG. 2). In this way, the shaft 132 can move seamlessly between any number of positions within the range of movement permitted by the universal joint 156. This configuration, for example, allows a user whose hand or wrist is secured to the wrist-ring structure 146 to move the shaft 132 along a relatively full range of arm and shoulder motion relative to the chair structure 106.

In some examples, the shaft 132 can move in any direction and form an angle relative to the longitudinal axis A at angles greater than 90 degrees. In other examples, the range of motion of the shaft 132 can be more restricted, such that an angle the shaft 132 can form relative to the longitudinal axis A can be any angle ranging from 0 degrees to 90 degrees, or any angle ranging from 0 degrees to 60 degrees, or within a relatively more restricted range.

In some examples, the first member 150 of the shaft 132 can be fixed relative to the second yoke 170 in such a way that the first member 150 does not rotate relative to the second yoke 170. The orientation of the first member 150, as well as the second member 152, in this example can be maintained while the shaft 132 moves about the longitudinal axis A. In other examples, however, the first member 150 can be coupled to the second yoke 170 in such a way that the first member 150 is free to rotate relative to the second yoke 170.

A resistance applied to the movement of the shaft 132 and thereby the resistance applied to a user's shoulder and arm, can be provided by the resistance mechanism 148. The resistance mechanism 148 operates to restrict movement of the universal joint 156 via the hydraulic members 158 and flow valves 160. The hydraulic members 158, for instance, can act to create a load between the cross 172 and the first and second yokes 164, 170 to provide variable resistance at the first and second pivot axes A1, A2 of the universal joint 156. In other words, the hydraulic members 158 act to restrict the movement of each yoke 164, 170 relative to the cross 172 in order to generate the resistance. While only one hydraulic member 158 is shown in FIG. 4, it should be understood that the second hydraulic member 158 can be coupled to the first yoke 164 on the opposite side of the resistance mechanism 148 shown in FIG. 4, such that the hydraulic members 158 lie within a common plane and form a 90-degree angle relative to one another.

Each hydraulic member 158 can include an axle (not shown) extending through a respective yoke and coupled to a corresponding point of the cross 172. Specifically, the axle or shaft of one hydraulic member 158 can extend through an opening of the first yoke 164 and into the cross 172, while the axle or shaft of the second hydraulic member 158 can extend through an opening of the second yoke 170 and into the cross 172 (e.g., the hydraulic member 158 shown in FIG. 4). In this arrangement, one hydraulic member 158 lies along the first pivot axis A1 formed by the first yoke 164 and cross 172, and the second hydraulic member 158 lies along the second pivot axis A2 formed by the second yoke 170 and cross 172. The hydraulic members 158 in this way, are operative to produce restrictive rotational forces acting between the first yoke 164 and the first pivot axis A1, and the second yoke 170 and second pivot axis A2 to provide the resistance to the user's movement of the shaft 132.

The housing 174 of each hydraulic member 158 can be coupled to the outer surface of its respective yoke 164, 170 and configured to rotate relative to its central axle or shaft. As such, the housing 174 of each hydraulic member 158 and its respective yoke move with one another in combination as the yoke pivots about the corresponding central axle and pivot axis (e.g., the first and second pivot axes A1, A2 of the universal joint 156).

Each hydraulic member 158, via hydraulic pressure, can be configured to restrict the relative rotation between its respective axle and housing 174 such that movement of the universal joint 156 about the first and second pivot axes A1, A2 can be restricted as the housing 174 resists movement of its corresponding yoke. Consequently, a resistive force can be applied to the shaft 132 in such a way that the multidirectional movement of the shaft 132 can be restricted, but the shaft 132 remains operable to move about the full range of motion provided by the universal joint 156. In particular, the shaft 132 can be manipulated along the full range of motion of the universal joint 156, but the ease or difficulty to which the shaft 132 is able to move can be modified via the force applied by the hydraulic members 158. For example, rotational movement of the universal joint 156 about the first and/or second pivot axes A1, A2 drives the hydraulic members 158, moving fluid through the hoses coupled to the members and variable flow valves 160 to generate the resistance. As such, the resistive force, or the degree to which the movement of the universal joint 156 and thereby movement of the shaft 132 is restricted, can be proportional to the hydraulic pressure of the hydraulic members 158. This hydraulic pressure can be regulated via hydraulic fluid delivered to the hydraulic members 158 by the flow valves 160, to increase and decrease the flow of hydraulic fluid and therefore, the degree of resistance applied to the movement of the shaft 132 and wrist-ring structure 146.

As shown in FIG. 4, each hydraulic member 158 can be coupled to a respective variable flow valve 160 by way of a hose 176. Each flow valve 160 can be linked via gearing to an adjustment knob 178. The knob 178 can, for instance, control both flow valves 160 at the same time to ensure the flow of hydraulic fluid to each member 158 is the same. Having the same flow rate of hydraulic fluid to the hydraulic members 158 can, for example, ensure the resistance applied to the universal joint 156 at the first and second pivot axes is equal (or substantially equal) and thereby, can restrict movement of the shaft 132 uniformly or substantially uniformly across the range of motion provided by the joint 156. As shown in FIG. 1, the knob 178 can be accessible external to the base 128 and therefore, can be easily adjusted.

FIG. 4 also shows the resistance mechanism 148 can include one or more transducers and/or rotational sensors communicatively coupled to a processor board 182. For instance, each hydraulic loop formed of a hydraulic member 158, hose 176, and flow valve 160, can also include a pressure transducer 180. These transducers 180 can be configured to measure pressure differences in the hydraulic loop that result from adjusting the resistance in flow via the adjustment knob 178 and can communicate those measurements to a processor board 182. In addition, the resistance mechanism 148 can also include one or more rotational position sensors 162 (e.g., digital and/or analog rotary encoders) configured to track the angular movement of the first and/or second pivot axes formed by the cross 172 and the first and second yokes 164, 170. In particular, a rotational position sensor 162 can be coupled to the first and second yokes 164, 170 and configured to measure the angular movement of the first and second yokes 164, 170 relative to the cross 172. These angular movements can also be communicated to the processor board 182.

As mentioned, the processor board 182 can be in communication with each transducer 180 and rotational position sensor 162. The processor board 182 can also be in wireless communication, for example, with an optical processor board 184 (FIG. 6B) on the shaft 132 to receive and record the telescoping motion and resistance load. In some examples, the processor board 182 can also be in wireless communication with one or more local or network processing environments (e.g., personal computer(s), mobile device(s), handheld device(s), etc.), web-based applications, and/or cloud computing environments, such that the data from the measurements from the transducers 180, rotational sensors 162, and/or data from the optical processor board 184 can be viewed in real time and/or post measurement. In such instances and in some examples, the flow of the hydraulic fluid can also be adjusted via a web-based application and/or a processing and/or computing environments.

Figure 5B:
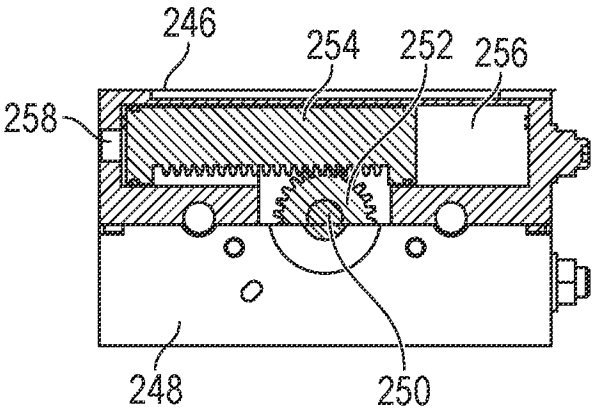
FIG. 5B is a half cross-sectional view of a hydraulic member of the resistance mechanism of FIG. 5A.
Figure 5A:
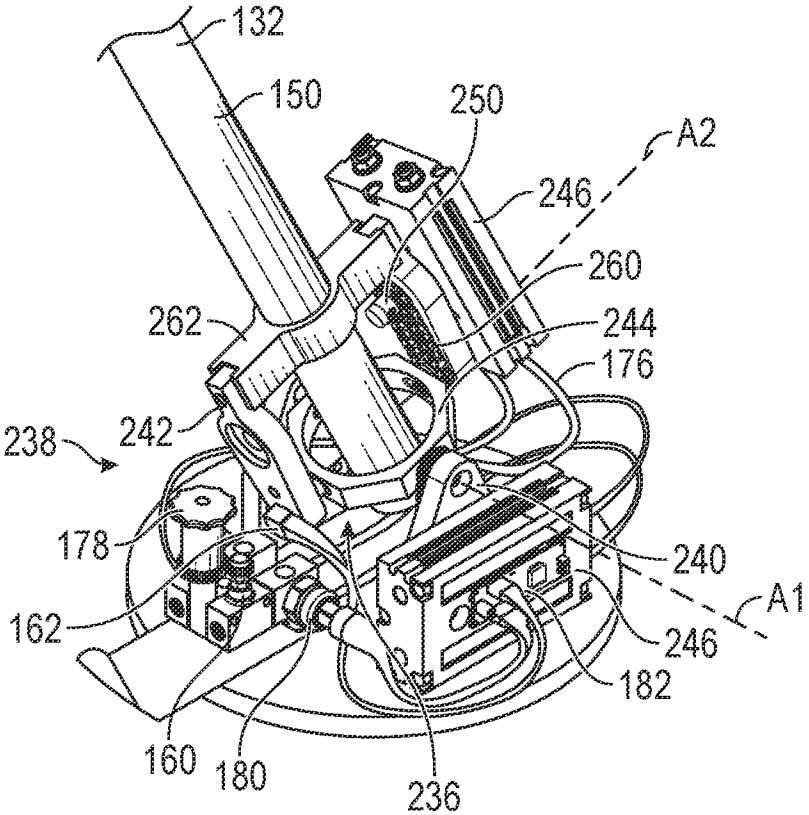
FIG. 5A is a perspective view of a resistance mechanism according to another example.

FIGS. 5A and 5B illustrate a universal joint 236 and resistance mechanism 238 according to another example. The universal joint 236 and resistance mechanism 238 can be structurally and functionally similar to the universal joint 156 and resistance mechanism 148 described herein. For instance, the universal joint 236 can include a first yoke 240 (or bracket) and a second yoke 242 coupled to the first yoke 240 via a central member 244, which operates similarly to the spider or cross 172. In this configuration, the first yoke 240 and the central member 244 form a first pivot axis A1', and the second yoke 242 and the central member 244 form a second pivot axis A2' perpendicular to the first pivot axis A1'.

As shown in FIG. 5A, the first member 150 of the shaft 132 can be coupled to the second yoke 242 via a cross member 262 of the yoke and extend through the opening formed by the central member 244. The opening of the central member 244 can be sized and shaped, for instance, to accommodate movement of the shaft 132 within the space of the opening when the shaft 132 and second yoke 242 are manipulated and moved about the second pivot axis A2'.

Still referring to FIG. 5A, the resistance mechanism 238 can also include all and/or any combination of components of the resistance mechanism 148, including one or more rotational position sensors 162, flow valves 160, pressure transducers 180, hoses 176, knobs 178, and processor boards 182. One difference between the resistance mechanism 238 and the resistance mechanism 148, however, is the hydraulic members used to generate the resistance. Specifically, the hydraulic members 158 of the resistance mechanism 148 are generally described as being configured as a hydraulic radial cylinders or actuators, while the hydraulic members 246 of the resistance mechanism 238 are configured as hydraulic gear assemblies.

As illustrated in FIG. 5B, which shows a half cross-sectional view of one of the hydraulic members 246, each hydraulic member 246 can include a housing 248, a shaft or axle 250, a pinion gear 252 coaxially aligned with and coupled to the axle 250, and a pair of cylinders 254. In the illustrated configuration, as the axle 250 and pinion gear 252 are rotated, the teeth of the pinion gear 252 which mate with corresponding teeth of the cylinders 254 (or gear rack thereof) drive the cylinders 254 back and forth and in opposite directions of one another as the axle 250 and pinion gear 252 rotate clockwise and counterclockwise relative to the housing 248. This linear movement of the cylinders 254 and the interaction between the cylinders 254 and hydraulic fluid flowing in and out of the respective cylinder barrels 256 through fluid ports 258, creates hydraulic pressure which restricts the rotation of the axle 250 and pinion gear 252 relative to the housing 248. This restricted rotation of the axle 250 and pinion 252 can provide the resistance to the universal joint 236 about the first and second pivot axes A1', A2' in the same or similar manner as the hydraulic members 158 described above.

Referring again to FIG. 5A, the housing 248 of each hydraulic member 246 can be coupled to the outer surface of its respective yoke 240, 242 such that each hydraulic member 246 and its respective yoke move with one another in combination. The axle 250 of one hydraulic member 246 can extend through an opening of the first yoke 240, and the axle 250 of the second hydraulic member 246 can extend through an opening of the second yoke 242. As shown in FIG. 5A, each axle 250 of the hydraulic members 246 can be coupled to the central member 244 via a belt and sprocket assembly 260. Each belt and sprocket assembly 260, for instance, can include two or more sprockets, including one sprocket fixed to the axle 250 of the hydraulic member 246 and another sprocket fixed to the central member 244 at a respective pivot axis. In other words, a first sprocket of each assembly 260 can be fixed to the central member 244 and coaxially aligned with a respective pivot axis of the joint 236, and a second sprocket of each assembly 260 can be coaxial with and fixed to the axle 250 of the corresponding hydraulic member 246. The belt of each assembly 260 in this configuration can extend around respective sprockets such that relative movement between the first and second yokes 240, 242 and the central member 244 causes the belts to rotate the axles 250 and pinion gears 252 of the hydraulic members 246. Stated another way, differential rotation of the yokes 240, 242 relative to the central member 244 drives the belt and sprocket assemblies 260 and thereby drives the axles 250 and pinion gears 252 of the hydraulic members 246 via their connection. Although described as a belt and sprocket system, it should be appreciated that in some examples, a chain, pulley, and/or other similar system can be used to drive the axles 250 and pinion gears 252.

Hydraulic pressure of the hydraulic members 246 can be operative to restrict the clockwise and counterclockwise rotation of the axles 250 and pinion gears 252. As a result, the ability of the belt and sprocket assemblies 260 to drive the axles 250 of the hydraulic member 246 can be restricted, thereby restricting relative rotation between the central member 244 and the first and second yokes 240, 242. As such, movement of the universal joint 236 about the first and second pivot axes A1', A2' can be restricted, and a resistive force can be applied to the shaft 132 in such a way that the multidirectional movement of the shaft can be restricted, but the shaft 132 remains operable to move about the full range of motion provided by the universal joint 236. In particular, the shaft 132 can be manipulated along the full range of motion of the universal joint 236, but the ease or difficulty to which the shaft 132 is able to move can be modified via the restriction applied by the hydraulic members 246. Accordingly, the resistive force, or the degree to which the movement of the universal joint 236 and thereby the shaft 132 is restricted can be proportional to the hydraulic pressure of hydraulic members 246. This hydraulic pressure can be regulated, for instance, via the hydraulic fluid delivered to the hydraulic members 246 by the flow valves 160, as described herein.

Although the disclosed universal joints 156, 236 and resistance mechanisms 148, 238 are described as being configured and/or arranged in a specified manner, it should be understood that a variety of other configurations and arrangements can be used to achieve the same or similar functionality as described herein. The joints for instance, need not be a universal joint, but can be any joint, such as a ball-and-socket joint or other joint, that can provide the same or similar range of motion of the disclosed universal joint 156 and universal joint 236. Also, the hydraulic members 158, 246 need not be the hydraulic cylinders or the hydraulic gear assemblies described herein but can be any hydraulic member and/or system configured to restrict movement of the joint and/or shaft. By way of example, the hydraulic members 246 can be configured to include a single cylinder, rather than a pair of cylinders, such that the hydraulic members 246 can be oriented and/or one or more components of the belt and sprocket assembly removed, while still providing the desired resistance to joint movement. As another example, one or more linear cylinders and/or pistons can be used in conjunction with or in place of the hydraulic members. It should also be appreciated that in addition to, or in lieu of, the hydraulic members, one or more additional mechanical and/or electrical components can be included to restrict the movement of the joint and/or shaft.

Figure 6B:
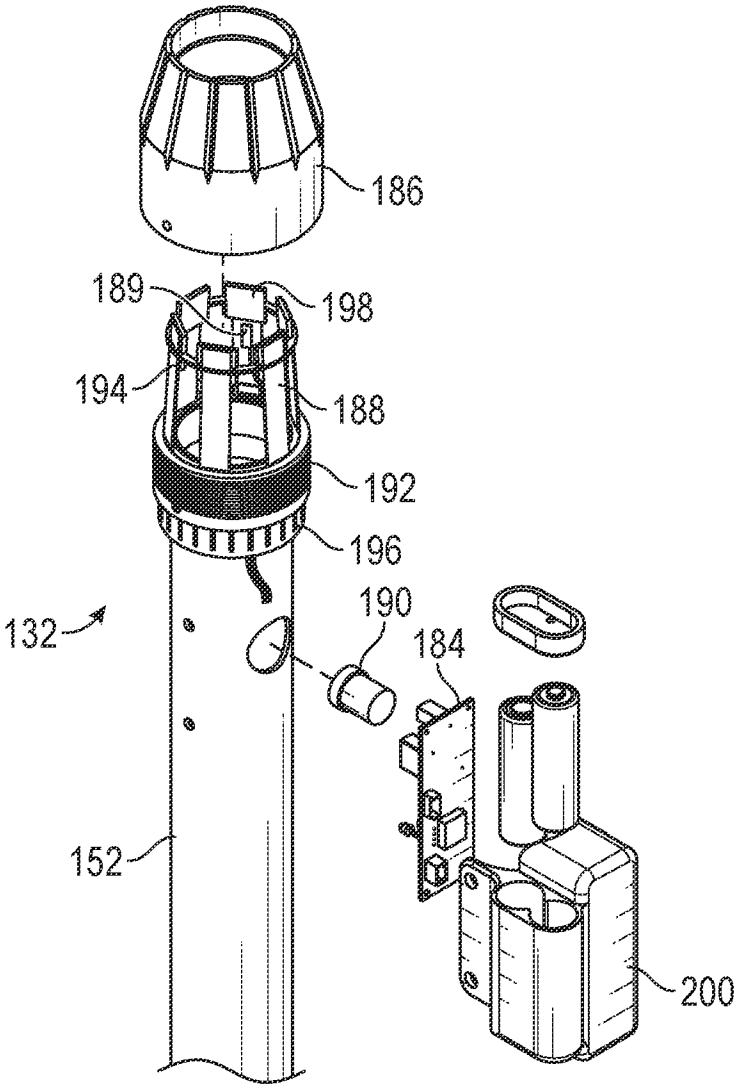
FIG. 6B is an exploded view of a first member of the telescoping shaft of FIG. 6A.
Figure 6A:
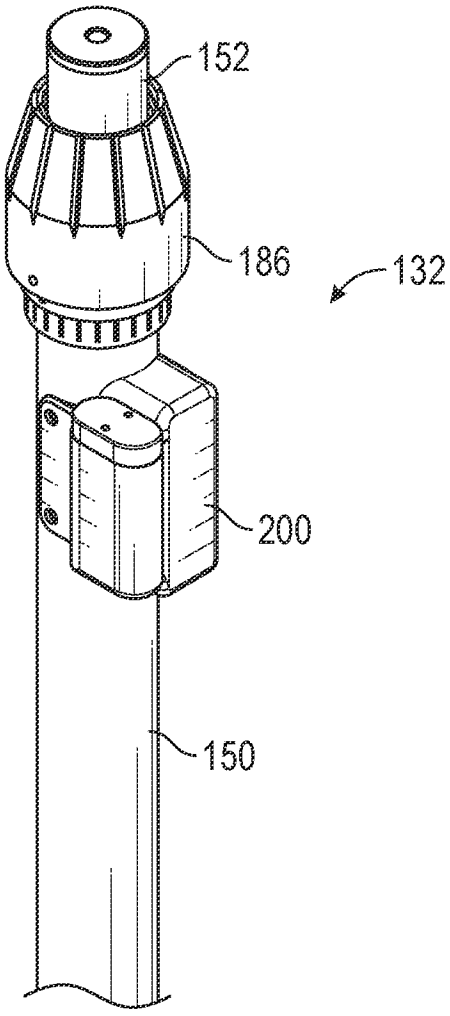
FIG. 6A is a perspective view of a telescoping shaft of the shoulder strengthening system of FIGS. 1-3.

Now turning to FIGS. 6A and 6B, the shaft 132 can include the first member 150, the second member 152, an adjustment ring 186, a plurality of leaf spring fingers 188, and an optical sensor 190. As previously mentioned, the second member 152 can be slidably coupled to the first member 150. As shown in FIG. 6A, the second member 152 has a diameter that is less than a diameter of the first member 150 such that the second member 152 can be configured to readily slide in and out of the first member 150. In this way, the shaft 132 can be said to be a telescoping shaft.

The second member 152 can be coupled to the first member 150 by way of the adjustment ring 186 and the plurality of leaf spring fingers 188 (FIG. 6B). As illustrated in FIG. 6B, the leaf spring fingers 188 can extend axially from and be circumferentially spaced from one another along the upper end of the first member 150. Each of the leaf spring fingers 188 can be angled inwardly in such a way as to contact and apply to the outer surface of the second member 152 a variable mechanical load, such as a frictional force, as the adjustment ring 186, that holds captive the slip ring 194, is adjusted. For instance, the adjustment ring 186 can be coaxially aligned with and extend over the second member 152 and leaf spring fingers 188. The adjustment ring 186 can be configured to mate with external helical ridges or threads 192 located on the outer surface of the first member 150 and proximate the leaf spring fingers 188. The adjustment ring 186 can, for example, include internal helical ridges or threads disposed on its inner surface which are configured to mate with the external ridges or threads 192 at the upper end of the first member 150. In this way, the adjustment ring 186 can be rotatably coupled to the first member 150 and rotation of the of the adjustment ring 186 can produce relative axial motion between the adjustment ring 186 and both the leaf spring fingers 188 and first member 150. The relative axial motion of the adjustment ring 186 can drive a slip ring 194 down the leaf spring fingers 188 (e.g., toward the threads 192), causing the angled spring fingers 188 to move inwardly to contact and apply a frictional force to the second member 152.

In this manner, the relative frictional force applied to the second member 152 can be proportional to the axial travel of the adjustment ring 186. For instance, the further the adjustment ring 186 travels along the external threads 192, the relatively greater the mechanical load/force is that is applied to the second member 152. Inversely, the further the adjustment ring 186 travels toward the leaf spring fingers 188, the relatively lower the mechanical load/force is that is applied to the second member 152. As such, the combination of the adjustment ring 186 and leaf spring fingers 188 can be configured to apply a variable frictional force to the second member 152 as the second member 152 slides in and out of the first member 150 such that the combination provides smooth and adjustable resistance to the telescoping motion of the shaft 132. In this way, a user seated at the shoulder strengthening system 100 is able, for example, to engage in exercises such as raises, presses, and overhead extensions because of this telescoping motion, the applied resistance of which can be adjusted via the adjustment ring 186.

In some examples, the adjustment ring 186 can be configured to travel the extent of the external threads 192 and couple to a lower fixed attachment ring 196 of the first member 150. In this configuration, the adjustment ring 186 can be configured to fix the position of the second member 152 relative to the first member 150 in such a way the second member 152 is stopped and prevented from sliding in and out of the first member 150. This can be useful in instances where the telescoping motion for an exercise or series of exercises, is undesired, and/or a fixed positioning of the user's arm is desired. For example, the fixed relative positioning of the second member 152 to the first member 150 can position the user's arm at an upward angle as the user moves the shaft 132 through the range of motion provided by a corresponding joint in order to target desired portions of the user's shoulder. Additionally or alternatively, the adjustment ring 186 can be configured to couple to the lower fixed attachment ring 196, but still allow the telescoping motion occur. In such instances, the coupling between adjustment ring 186 and the attachment ring 196 can indicate a maximum frictional force is applied to the second member 152.

In still further examples, the free end of one or more of the leaf spring fingers 188 can include a felt pad 198. The felt pads 198 can create friction between the leaf spring fingers 188 and second member 152, but prevent direct contact between these rigid components, contact which might otherwise cause undesired wear and increase in frictional forces. In this way, the felt pads 198 can provide consistent frictional forces over extended periods of use and prolong the longevity of the components and functionality of the shaft 132. The felt pads 198 can also contribute to the smooth telescoping motion of the shaft 132 despite the presence of friction.

Although the first member 150 is described as being coupled to the universal joint 156 and the second member 152 described as being coupled to the wrist-ring structure 146, it should be appreciated that this arrangement of the first and second members 150, 152 of the shaft 132 can be reversed. For instance, the first member 150 can be coupled to the wrist-ring structure 146 and the second member 152 coupled to the universal joint 156. In this arrangement, the shaft 132 maintains the same telescoping and resistance functionality as described herein. In this alternative arrangement, the second member 152 can be referred to as an inner, first member, and the first member 150 referred to as an outer, second member.

FIG. 6B shows the shaft 132 can also include one or more sensors and/or gauges. Specifically, the first member 150 can include an optical processor board 184 with a communicatively coupled optical sensor 190 configured to track and measure the telescoping position/motion of the second member 152 relative to the first member 150. The optical sensor 190 can, for instance, utilize an ultraviolet light-emitting diode (UV-LED) lens to capture the motion of the second member 152 in and out of the first member 150. In addition, a strain gauge 189 can be mounted to one or more leaf spring fingers 188 and configured to measure the deflection of, or in other words, the bending load applied to, the specified leaf spring fingers 188 by way of the adjustment ring 186 and slip ring 194. As such, the strain gauge 189 can measure the resistance applied to the second member 152. The strain gauge 189 in this case, can also be communicatively coupled to the optical processor board 184.

As previously mentioned, the optical processor board 184 can be in wireless communication with the processor board 182 (FIG. 4) of the resistance mechanism 148. In this manner, the optical processor board 184 can be configured to capture and transmit the data corresponding to the telescoping position and/or deflection measurements to the processor board 182. Accordingly, this data can be communicated via the processor board 182 to one or more web-based applications, computer processing environments, cloud computing environments, or a combination thereof. In some examples, however, the optical processor board 184 can communicate directly with one or more of those channels immediately described above (e.g. via wireless communication, such as Bluetooth).

As shown in FIG. 6B, the optical processor board 184 can be enclosed and coupled to the first member 150 via a housing 200 that is also configured to encase one or more batteries to power the processor board 184. Although the processor board 184 can be powered in a variety of ways. For instance, one or more dry cell batteries, hardwired power source, and/or one or more rechargeable batteries (e.g., via a universal serial bus) can be used.

Although the disclosed should strengthening system 100 is described as having one or more transducers, sensors, or gauges, it should be appreciated the system need not include these features to function but is enhanced by the added functionality and benefits they provide. Moreover, though quantities of individual components described herein are specified with particularity, it should be understood one or more components may be added or removed while still allowing the shoulder strengthening system to fully function in accordance with the present disclosure.

FIGS. 7A and 7B depict the wrist-ring structure 146 coupled to the upper end of the second member 152 of the shaft 132. The wrist-ring structure 146 can include a ring 202, a shuttle 204 movably coupled to the ring 202, and a brace 206 coupled to the shuttle 204. As shown in FIGS. 7A and 7B, the brace 206 can be configured to support and secure the hand and wrist of an individual user of the shoulder strengthening system 100. For instance, the brace 206 can include a rearward portion 210 configured to securely support the wrist and forearm of the user, and a frontward, curved portion 212 configured to securely support the palm and fingers. The curved portion 212 in this case, causes the palm and fingers to arc toward the forward end of the brace 206. This configuration of the frontward portion 212 which curls the palm and fingers of the user's hand can provide significant benefits, such as by ensuring the user's movement is primarily isolated to shoulder movement, rather than other parts of the arm. In particular, in their relaxed state, the flexor muscles of the hands and forearms flex the digits of the hand with greater force than the extensors, thus by allowing the hand to remain as ergonomically natural as possible, muscle tension and the forces across unwanted joints, such as in the wrist and elbow, decrease and allow further isolation of the shoulder joint.

The brace 206 can also include one or more fastening mechanisms 214, such as a strap or an elastic component to securely retain and restrict the movement of the user's arm, wrist, and hand relative to the brace 206. The fastening mechanisms 214 in this configuration can prevent the hand from moving in an upward direction, such as when the hand wants to draw or lift away from the surface of the brace 206. This also ensures user movement is directed primarily to isolated shoulder movement, as opposed to relying too heavily on hand movement to manipulate the positioning of the shaft 132 and thereby detracting from the intended dynamic 360-degree shoulder movement.

In some examples, the rearward portion 210 and/or the curved portion 212 can also be molded or formed to receive and better retain the corresponding anatomy. This, among other things, allows the brace 206 to be suited for general support and comfort. Although described as a brace to support and secure the wrist and hand of the user, it should be appreciated the brace 206 can be configured in a variety of ways. For example, in addition to or in lieu of the brace 206, a brace can be constructed to securely support the upper forearm, the upper arm, and/or the elbow joint. As an example, and as will be described in reference to FIGS. 8A-8D, a brace 234 can be configured to secure the upper arm while the shoulder strengthening system 100 is oriented in such a way as to target portions of the shoulder not generally targeted by conventional equipment.

As shown in FIGS. 7A and 7B, the brace 206 can be coupled to the shuttle 204 movably coupled to the ring 202. The shuttle 204 can include a jaw structure 216 configured to receive and engage with the edges of the ring 202. The inner surface of the jaw structure 216 can include one or rollers (not shown) to engage the surface of the ring 202 such that the shuttle is operable to move along the path formed by the edges of the ring 202 in a smooth continuous motion. In this manner, the shuttle 204 and the brace 206 can be free to move clockwise and counterclockwise along the circumference of the ring 202. As such, the brace 206 and shuttle 204 can be configured to rotate, as indicated by arrow 207, about a longitudinal axis of the ring 202 extending through the center of the ring 202 and perpendicular to the plane of the ring 202. In this way, the shuttle 204 and brace 206 can be said to move or rotate about a first axis of the wrist-ring structure 146.

FIGS. 7A and 7B show the shuttle 204 can also include a control lever 218, which can control the movement of the shuttle 204 about the ring 202. The control lever 218, for instance, can be configured to both fix the positioning of the shuttle 204 relative to the ring 202 and to enable the shuttle 204 to move freely about the circumference of the ring 202. By way of example, when the control lever 218 is in an upward, first position (FIGS. 7A-7B), the shuttle 204 and thereby the brace 206 can be in a fixed position relative to the ring 202. In this way, the shuttle 204 and brace 206 can be positioned and fixed at any point along the circumference of the ring 202. Inversely, while the control lever 218 is in a second, downward position (e.g., directed toward the second member 152 in FIG. 7A), the shuttle 204 and brace 206 can be in a "free rotation" state, meaning the shuttle and brace are free to rotate about the first axis of the wring structure 146 and circumference of the ring 202.

The control lever 218 can also be configured to toggle between the first position and a third position such that the shuttle 204 can be quickly switched between a fixed state and a free rotation state. Specifically, the control lever 218 can be pulled upward from the first position and into the third position (e.g., toward the brace 206), to switch the shuttle 204 from a fixed state to a momentarily free rotation state until the control level 218 is returned to the first position. In this case, the control lever 218 can be spring loaded to automatically return the control lever 218 to the first position from the third position. The control lever 218 configured to toggle in this way can, for example, allow an individual user whose hand and wrist are secured to the brace 206 to switch between the fixed state and free rotation state by pulling up on the control lever 218 with one or more fingers extending past the frontward end of the brace 206.

As depicted in FIGS. 7A and 7B, the ring 202 can be coupled to a pair of upwardly extending arms of a U-shaped bracket 220. The ring 202 can be coupled to the bracket 220 via the openings 222 of the arms. Each opening 222 of the bracket 220 can, for example, include a bushing (not shown) such that the ring 202 is configured to pivot relative to the bracket 220 in a fore-and-aft motion about an axis extending through the openings 222. This fore-and-aft motion is indicated by arrows 221. As such, the shuttle 204 and brace 206 are also configured to pivot backward and forward relative to bracket 220 as the ring 202 pivots about the axis extending through the openings 222. In this way, the ring 202, shuttle 204, and brace 206 can all be said to move or pivot about a second axis of the wrist-ring structure 146.

Still referring to FIGS. 7A and 7B, the ring 202 and U-shaped bracket 220 can be coupled to the upper end of the second member 152 via a release mechanism 224. The bracket 220, for example, can be coupled (e.g., bolted) to an attachment block 223. A spring lever 227 of the release mechanism 224 can then be configured to seize and hold firmly the attachment block 223 whereby the bracket 220 is securely coupled to the release mechanism 224 in a way that is free of shaking or rattling. The release mechanism 224 can be coupled to the upper end of the second member 152 by way of a bolt and a T-bushing such that the release mechanism 224, bracket 220, and ring 202 are able to rotate clockwise and counterclockwise about a longitudinal axis of the second member 152, bracket 220, and release mechanism 224. In this manner, the wrist-ring structure 146 and each component thereof, including the brace 206 and shuttle 204, can be said to move or rotate about a third axis of the wrist-ring structure 146, as indicated by arrows 225. The movement of the wrist-ring structure 146 about the first, second, and third axes A1, A2, A3 can provide ample movement relative to the shaft 132 so that the user can freely move their hand, wrist, and arm as the user acts to manipulate the shaft 132 in various directions.

Although described as being coupled to a wrist-ring structure, it should appreciated that, in some examples, the shafts described herein need not include the wrist-ring structure, but can be coupled to a member or structure which is stationary relative to the shaft.

As mentioned, the shoulder strengthening system 100 can also include a support 104 rotatably coupled to the front post 110 of the frame 108. Referring again to FIGS. 1-3, the support 104 can include a padded structure 226 coupled to its upper most end. The support 104 and the padded structure 226 can be configured to bear the weight of and/or limit rearward motion of the arm of an individual user during use of the shoulder strengthening system 100. The padded structure 226, for instance, can abut and support the posterior of the arm to limit rearward motion of the individual user's arm when avoidance of such rearward movement is desired. In this way. the padded structure 226 can immobilize the upper-extremity joint motion around the elbow which directs and isolates the acting forces toward the shoulder. Moreover, the padded structure 226 can also brace the elbow and forearm of the user. As an example, while the hand of the user is retained by the wrist-ring structure 146, the user can move or pivot their hand, wrist, and forearm relative to the padded structure 226 as the user manipulates the positioning of the shaft 132. In some examples, the padded structure 226 can be moveably coupled to the support 104 such that the padded structure 226 can be positioned at a variety of angles and orientations relative to the upper end of the support 104. For example, the padded structure 226 can be tilted toward the chair structure 106 or the shaft 132.

As shown in FIGS. 1-3, the support 104 can also be constructed of a telescoping shaft 228 that allows the length of the shaft 228 to be adjusted. In some examples, the shaft 228 can include a lever or handle (not shown) configured to allow the relative position of an inner, second member 230 and an outer, first member 232 to be adjusted, as indicated by arrows 229. In such examples, the lever can be configured in such a way as to allow an individual whose hand and wrist are secured by the wrist-ring structure 146, to adjust the length of the shaft 228 with their free hand. In this configuration, a biasing member, such as a spring or like mechanism, can bias the second member 230 such that the second member 230 extends automatically upward without external influence while the said lever is in a first position. While the handle is in this first position, the user can also press downward against the upward movement of the second member 230, such as with their elbow, to place the second member 230 and padded structure 226 in a desired position. Once in a desired position, the handle can be moved to a second position to fix the position of the second member 230 relative to the first member 232. In other examples, the shaft 228 can be structurally and functionally similar to the shaft 132, such as by including an adjustment ring and a plurality of leaf spring fingers.

Though FIGS. 1-3 show the resistance system 102 and support 104 of the shoulder strengthening system 100 in a particular configuration, e.g., generally to the right of the chair structure 106, it should be appreciated the resistance system 102 and support 104 can be positioned in a variety of configurations. For instance, the resistance system 102 and support 104 can be positioned to accommodate both the left and right sides of the body and to target specific anatomy of the shoulder.

Referring to FIGS. 8A-8D and by way of example, the base 128 and resistance system 102 can be positioned back behind and to the left rear of the chair structure 106 with the shaft 132 angled behind and to the right. In this configuration, a brace 234 formed to secure and support the upper arm and/or forearm of a user can replace the wrist-ring structure 146 and be positioned proximate the right side of the chair structure 106. The wrist-ring structure 146 and the brace 234, for instance, can be interchangeable via their coupling to the release mechanism 224. An individual seated in the chair structure 106 and whose arm is fastened to the brace 234 in this configuration can abduct their arm, i.e., move the arm from a position parallel to the torso to a position perpendicular to the torso. This abduction can be done, for example, under resistance via the mechanical load applied to the second member 152 by the adjustment ring 186 and leaf spring fingers 188, to target the muscles responsible for this action. In particular, the two primary muscles in control of the 90-degree abduction can be targeted, including the supraspinatus (e.g., initial 15 degrees of abduction) and the deltoid (e.g., the remaining 75 degrees). This, among other things, provides a significant advantage over conventional methods and exercise equipment which are typically unable to directly target the supraspinatus muscle.

FIGS. 9A-13B depict a shoulder strengthening system 300 according to another example. As illustrated in FIGS. 9A-13B, the shoulder strengthening system 300 can include a resistance system 302, a frame 304, and a platform 306 movably coupled to the frame 304. The frame 304 can include a base 308 and an adjustment mechanism 310 coupled to the resistance system 302 and the base 308. The platform 306 can be pivotably coupled (e.g., hinged) to the base 308 such that the platform 306 can be moved between a stowable state (FIGS. 9A-9C) and an operational state (FIGS. 10A-13B).

Figure 9C:
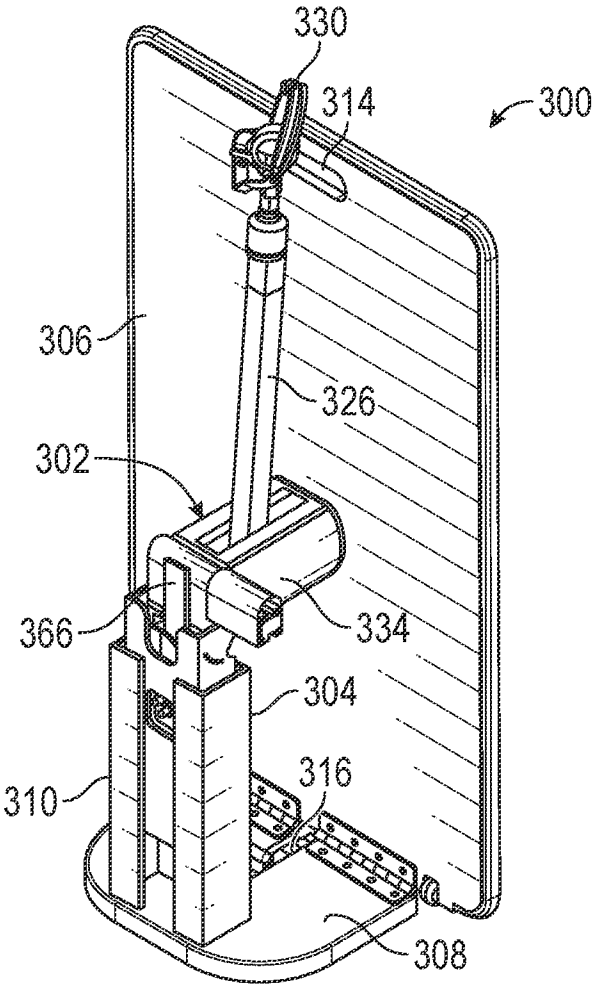
FIG. 9C is a perspective view of the shoulder strengthening system of FIGS. 9A-9B.
Figure 9B:
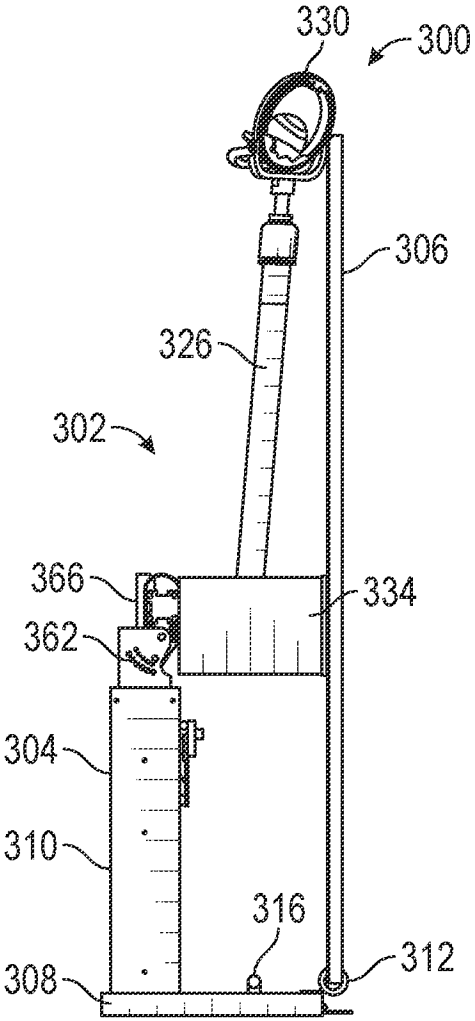
FIG. 9B is another side view of the shoulder strengthening system of FIG. 9A.
Figure 9A:
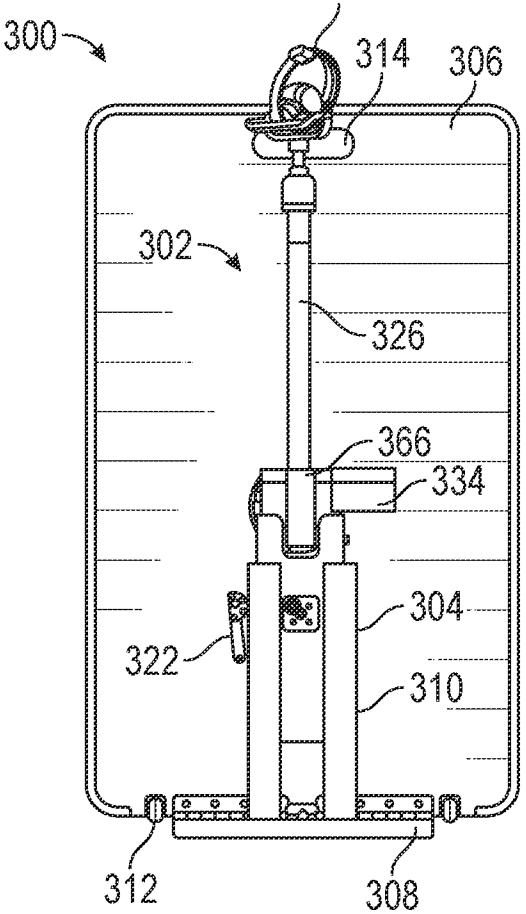
FIG. 9A is a side view of a shoulder strengthening system according to another example.

As shown in FIGS. 9A-9C, while in the stowable state, the platform 306 can be positioned in a "vertical" or longitudinal orientation such that the shoulder strengthening system 300 has a relatively low profile and decreased footprint for stowing or packing the system 300. The shoulder strengthening system 300 can, for example, be packed and stowed in a corresponding case for storage or transport when in the stowable state. The total depth of the shoulder strengthening system 300 while in the stowable state can also be relatively equal or nearly equal to the depth of the base 308 and/or the other components described herein (e.g., FIG. 9B). In some examples, the platform 306 and/or base 308 can include one or more wheels 312 and/or handles 314 such that the shoulder strengthening system 300 can be readily moved from one location to another. A locking assembly 316 of the base 308 and/or platform 306 can be included and used to lock in and move the platform 306 between the stowable and operational states.

Figure 10A:
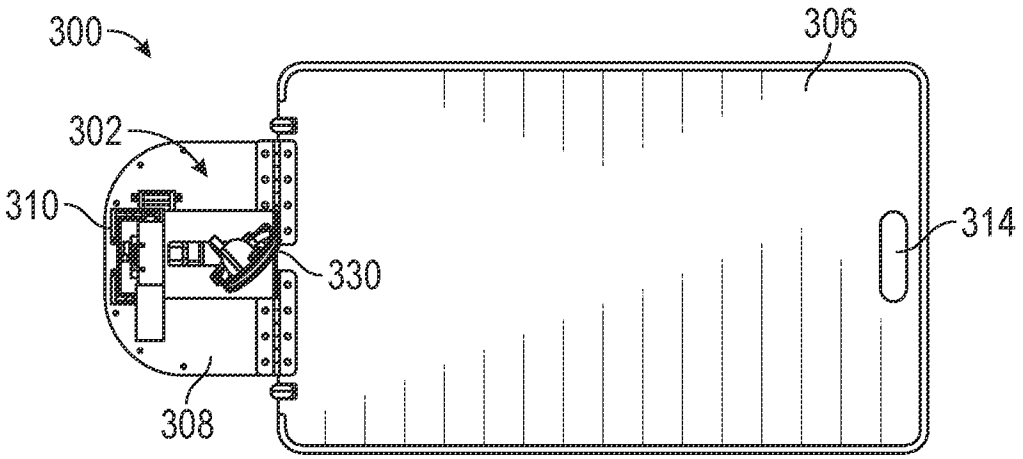
FIG. 10A is a top-down view of the shoulder strengthening system of FIGS. 9A-9C in an operational state.
Figure 10C:
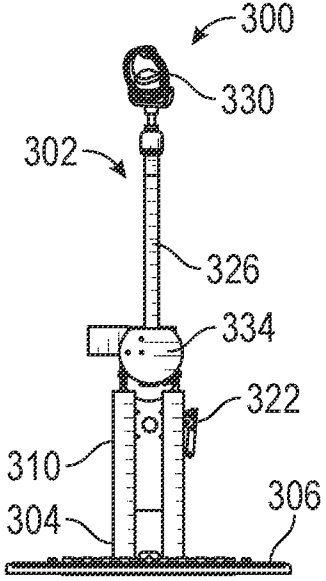
FIG. 10C is another side view of the shoulder strengthening system of FIGS. 9A-10B.
Figure 10B:
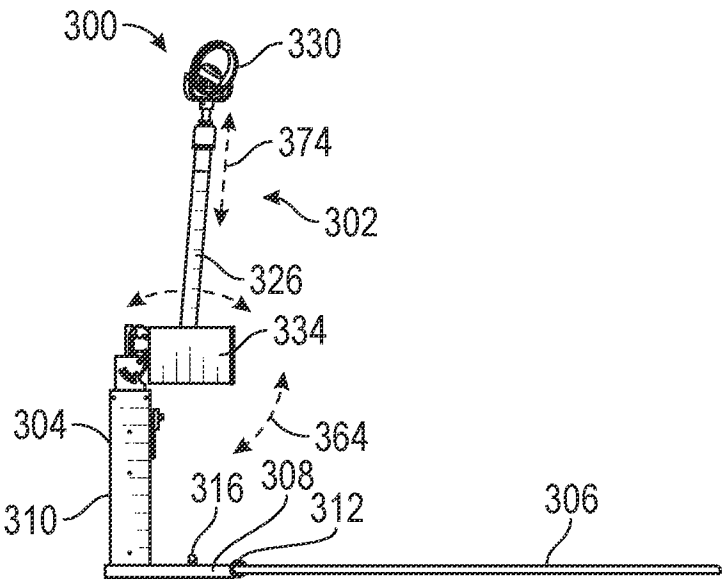
FIG. 10B is a side view of the shoulder strengthening system of FIGS. 9A-IOA.
Figure 11:
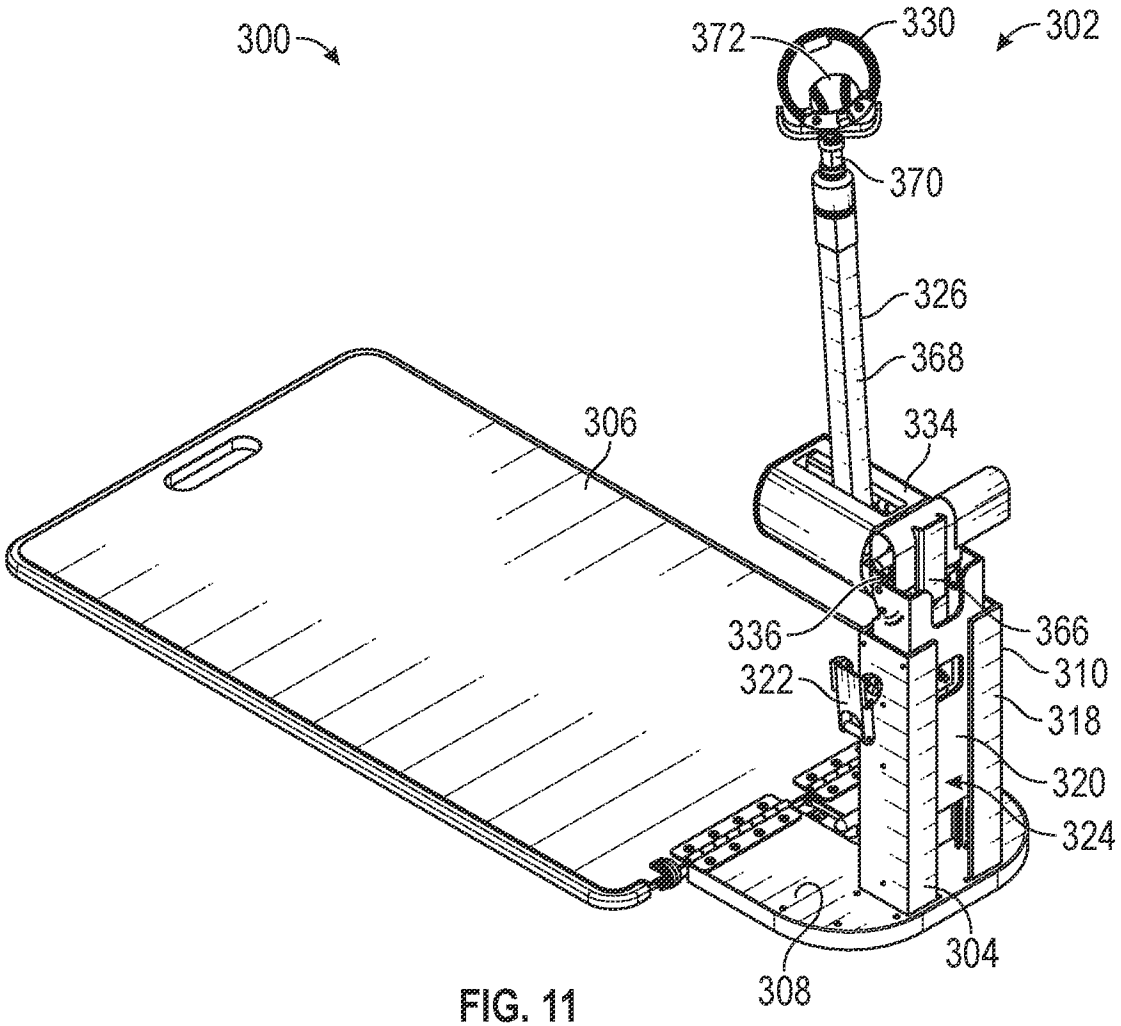
FIG. 11 is a perspective view of the shoulder strengthening system of FIGS. 9A-10C.
Figure 12B:
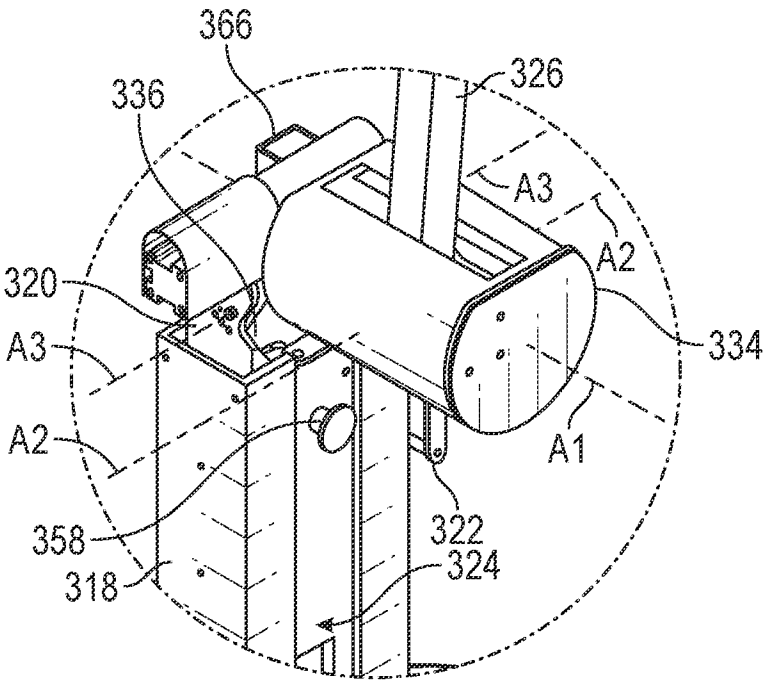
FIG. 12B is a magnified view of a resistance system of the shoulder strengthening system of FIG. 12A.
Figure 12A:
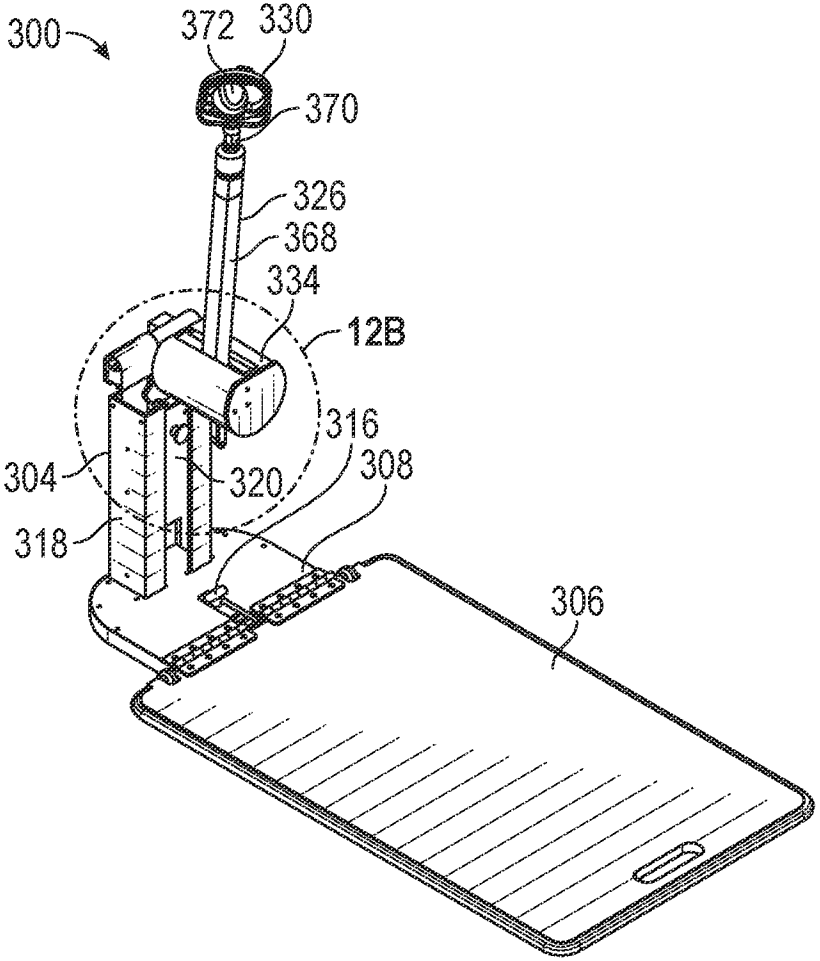
FIG. 12A is another perspective view of the shoulder strengthening system of FIGS. 9A-11.

Referring to FIGS. 10A-10C, when in the operational state, the platform 306 can be positioned in a "horizontal" orientation, i.e., parallel to the ground surface, to provide users a place to stand and position themselves while interacting with the resistance system 302. In some examples, the weight of the user atop the platform 306 can be suitable to provide stability and anchor the shoulder strengthening system 300 to the ground surface while the user is interacting with the resistance system 302. In such examples, the overall weight of the shoulder strengthening system 300 can be reduced, such as to optimize the weight of the system for stowing and packing, while taking advantage of users' weight to anchor the strengthening system 300 to the ground surface. In other examples, the weight of the platform 306 and/or surface area of the platform 306 in contact with the ground can itself be suitable to stabilize and anchor the shoulder strengthening system 300. Other components such as ties, fasteners, or weights can also be included and used to secure the strengthening system 300 to the ground surface.

Although described as including a movable platform 306, in some examples, the platform 306 need not be coupled to the frame or movable. For instance, the platform 306 can be secured to the ground surface separately of the base 308 and/or immovably coupled to the base 308 during setup of the strengthening system 300. In other examples, the platform 306 need not be included and the base 308 can be secured to the local ground surface and/or be sized and weighted to stabilize and anchor the shoulder strengthening system 300.

As shown in FIGS. 11-13B, the adjustment mechanism 310 can include a first adjustment member 318 and a second adjustment member 320 movably coupled to the first adjustment member 318. The first adjustment member 318 can be coupled to the base 308 such that the combination of the first adjustment member 318, second adjustment member 320, and base 308 form the principal support for the shoulder strengthening system 300. As illustrated in FIGS. 11-13B, the first adjustment member 318 can have a hollow body configured to receive the second adjustment member 320. The second adjustment member 320 can be coaxially aligned with and slidably coupled to the first adjustment member 318 such that the second adjustment member 320 and resistance system 302 can move axially relative to the first adjustment member 318 and base 308. For instance, the second adjustment member 320 can move axially in and out of the hollowed body of the first adjustment member 318. As such, the height or vertical positioning of the resistance system 302 relative to the base 308 and platform 306 can be adjusted by moving the second adjustment member 320 and resistance system 302 in an axial "upward" direction away from the base 308 and in an axial "downward" direction toward the base 308.

Vertical positioning of the resistance system 302 relative to the base 308 and platform 306 can be adjusted via lever 322 (e.g., a cam handle or lever). For instance, when positioned in a first position, the lever 322 is configured to fix the position of the second adjustment member 320 relative to the first adjustment member 318. When positioned in a second position, the lever 322 is configured to release the second adjustment member 320 such that the second adjustment member 320 moves axially relative to the first adjustment member 318 and base 308. An axially extending gap 324 within and along the sidewalls of the first adjustment member 318 can allow the resistance system 302 and components thereof to move with the second adjustment member 320 as the second adjustment member 320 moves toward the base 308 and below an upper most edge of the first adjustment member 318. In other words, components of the resistance system 302 coupled to the second adjustment member 320 (e.g., movable joint 328 and resistance mechanism 332) can extend outwardly and between the gap 324 without contacting the first adjustment member 318 as the second adjustment member 320 moves axially toward the base 308.

In the above example, the first adjustment member 318 forms a stationary outer adjustment member (e.g., stationary relative to the base 308) while the second adjustment member 320 forms a movable inner adjustment member configured to move or slide relative to the first adjustment member 318 and the base 308. However, in some examples, the second adjustment member 320 can be a stationary inner adjustment member while the first adjustment member 318 can be a movable outer adjustment member configured to move or slide relative to and along an outer surface the inner adjustment member. In such examples, the resistance system 302 can be coupled to the movable outer adjustment member.

As shown in FIGS. 11-13B, coupled to the second adjustment member 320 is the resistance system 302. The resistance system 302 can include a shaft 326 coupled to the frame 304 via a movable joint 328 (FIGS. 13A-13B), a wrist-ring structure 330 coupled to the shaft 326, and a resistance mechanism 332 (FIGS. 13A-13B) configured to restrict movement of the shaft 326 and wrist-ring structure 330 relative to the frame 304 of the system. As illustrated in FIGS. 9A-12B, one or more covers 334 can be situated as to conceal and enclose the movable joint 328 and resistance mechanism 332.

Figure 13A:
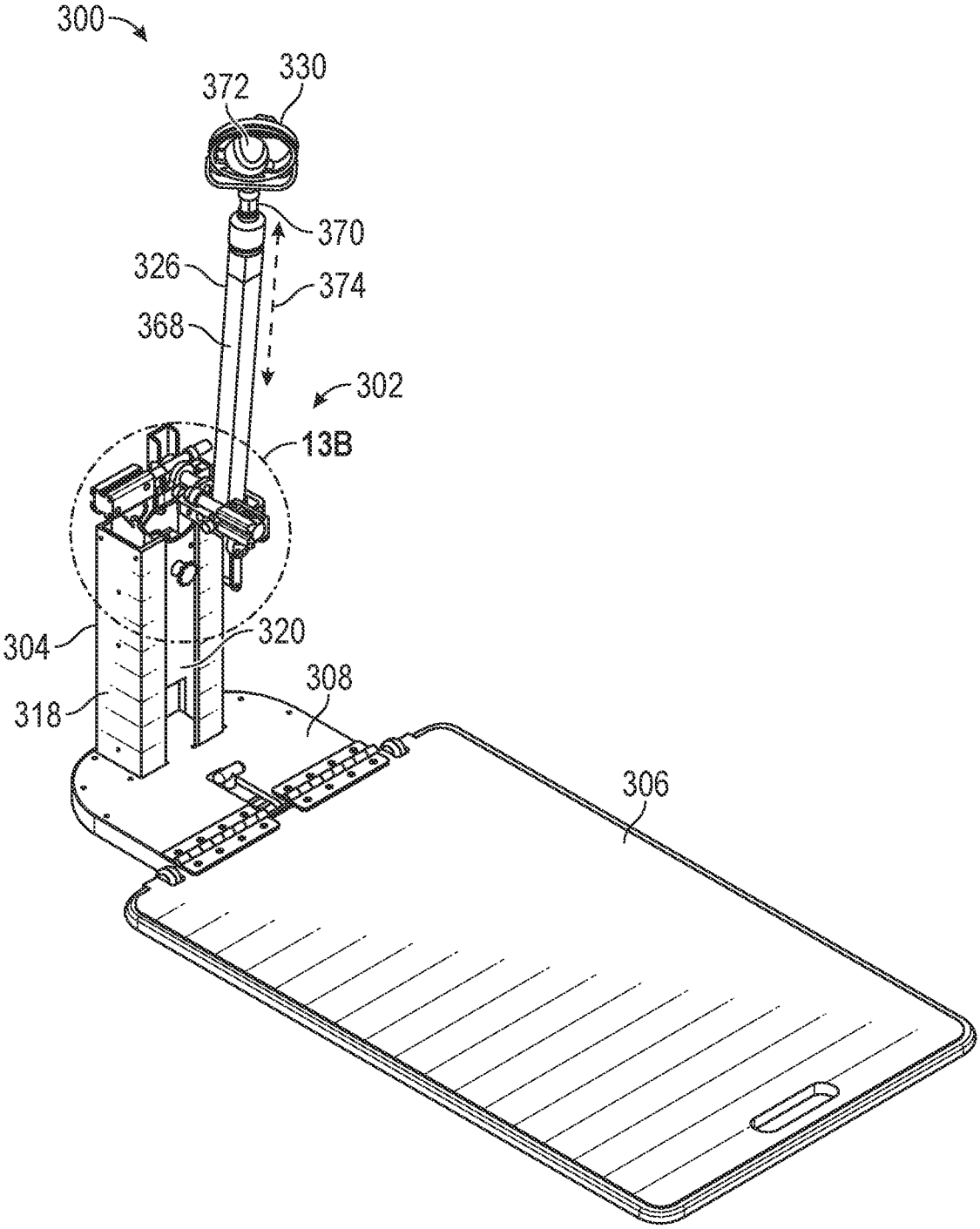
FIG. 13A is another perspective view of the shoulder strengthening system of FIGS. 9A-12B.
Figure 13B:
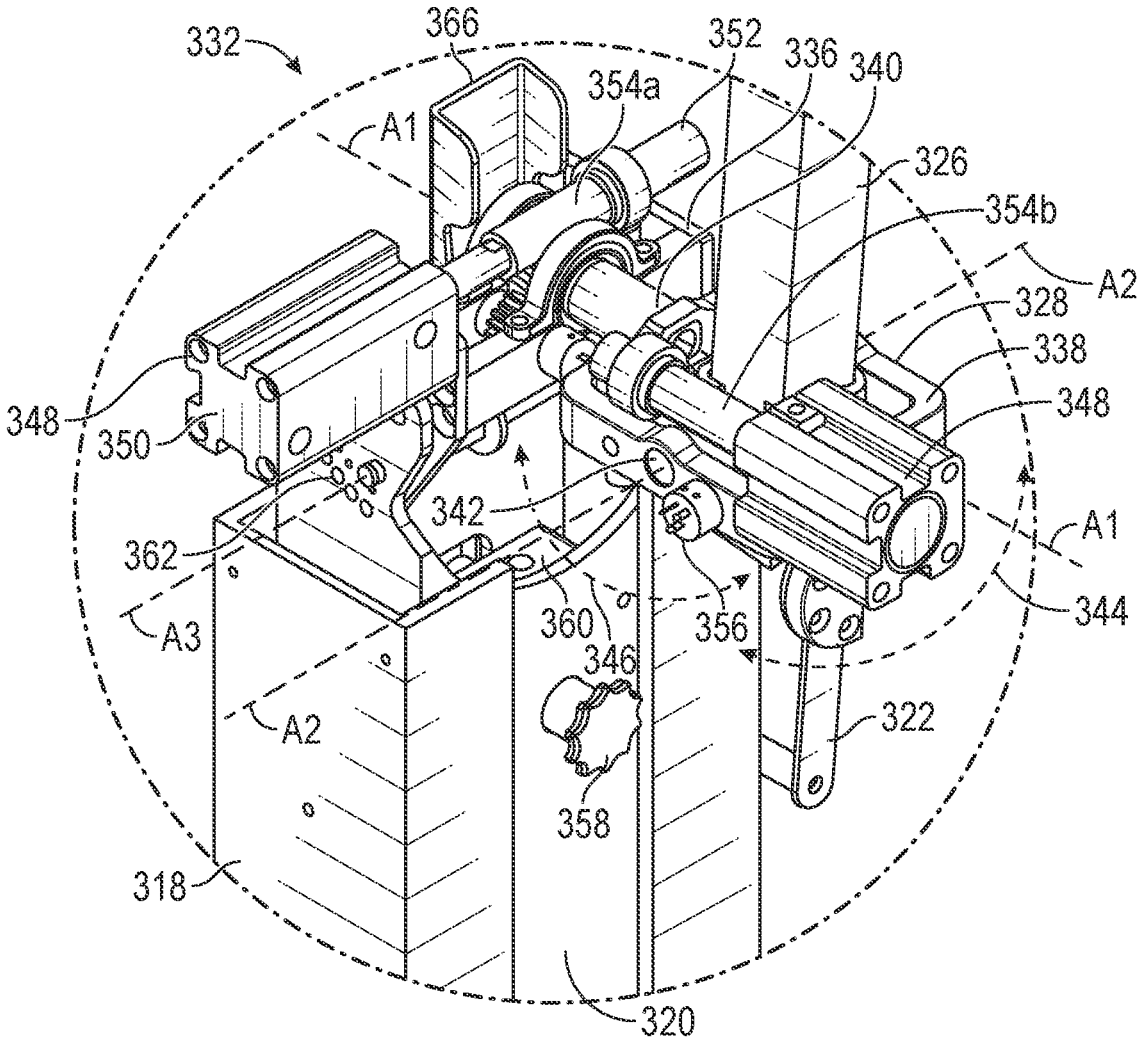
FIG. 13B is a magnified view of the resistance system of the shoulder strengthening system of FIG. 12B with a cover removed.

FIG. 13B shows a magnified view of the movable joint 328 and resistance mechanism 332 of the resistance system 302 with the cover 334 removed. The movable joint 328 and resistance mechanism 332 can provide the same or similar functionality as the universal joint 156 and resistance mechanism 148 (FIG. 4) and the universal joint 236 resistance mechanism 238 (FIGS. 5A-5B) described herein. For instance, the movable joint 328 and resistance mechanism 332 of the resistance system 302 are configured to provide the same range of multidirectional movement and resistance to that multidirectional movement as those joints and resistance mechanisms already described. In particular, the movable joint 328 includes a first support or bracket 336 coupled to the second adjustment member 320 of the adjustment mechanism 310, and a second support or bracket 338 movably coupled to the first bracket 336 and the shaft 326. The second bracket 338 can, for example, be a cantilevered bracket rotatably coupled to the first bracket 336. The portion of the second bracket 338 coupled to the first bracket 336 can form a first axle or gear shaft 340 and a first pivot axis A1 of the movable joint 328. In a similar manner, the shaft 326 can be rotatably coupled to the second bracket 338 via a second axle or gear shaft 342 forming a second pivot axis A2 by which the shaft 326 pivots relative to the second bracket 338.

In this configuration, the second bracket 338 and shaft 326 are configured to pivot clockwise and counterclockwise relative to the first bracket 336 and adjustment mechanism 310 about the first pivot axis A1, while the shaft 326 is configured to pivot relative to the first and second brackets 336, 338 and the adjustment mechanism 310 about the second pivot axis A2. The shaft 326, for instance, can be configured to pivot about the second pivot axis A2 toward and away from the first bracket 336 and adjustment mechanism 310. This movement of the movable joint 328 about the first and second pivot axes A1, A2 is generally indicated by arrows 344 (e.g., about the first pivot axis and first gear shaft 340) and arrows 346 (e.g., about the second pivot axis and second gear shaft 342), respectively, in FIG. 13B. The movement of the movable joint 328 can be measured via one or more rotational position sensors 356 (e.g., rotational sensors 162), such as digital and/or analog rotary encoders.

As shown in FIG. 13B, the resistance mechanism 332 can include a pair of hydraulic members 348 coupled to the first and second brackets 336, 338 of the movable joint 328. Each hydraulic member 348 can include a respective housing 350, a cylinder (not shown) received within the housing 350, and a rack and pinion assembly 354 coupled to the cylinder and a corresponding gear shaft, such that the hydraulic members 348 are situated to restrict rotation of the first and second gear shafts 340, 342. For instance, a pinion gear of the rack and pinion assembly 354*a* of the hydraulic member 348 coupled to the first bracket 336 can be coupled to and coaxially aligned with the first gear shaft 340. Likewise, a pinion gear of the rack and pinion assembly 354*b* of the hydraulic member 348 coupled to the second bracket 338 can be coupled to and coaxially aligned with the second gear shaft 342 coupling the shaft 326 to the second bracket 338. A gear rack 352 of each rack and pinion assembly 354 can also be coupled to and coaxially aligned with a respective cylinder in such a way that the teeth of each gear rack 352 mates with the teeth of a respective pinion gear.

In the configuration illustrated in FIG. 13B, as the first and second gear shafts 340, 342 are rotated clockwise and counterclockwise relative to the first and second brackets 336, 338, the rack and pinion assemblies 354 drive the cylinders in a linear fashion within a respective housing 350. This linear movement of the cylinders and the interaction between the cylinders and a hydraulic fluid within the housing 350 creates hydraulic pressure operative to restrict the clockwise and counterclockwise rotation of the first and second gear shafts 340, 342 and pinion gears. As such, the ability of the first and second gear shafts 340, 342 and rack and pinon assemblies 354 to drive the cylinders can be restricted, thereby restricting relative rotation between the second bracket 338 and the first bracket 336 and between the shaft 326 and the second bracket 338. As a result, the movement of the movable joint 328 about the first and second pivot axes A1, A2 can be restricted, and a resistive force is applied to the shaft 326 in such a way that the multidirectional movement of the shaft is restricted, but the shaft 326 remains operable to move about the full range of motion provided by the movable joint 328. The shaft 326 can be manipulated along the full range of motion of the movable joint 328, but the ease or difficulty to which the shaft 326 is able to move can be modified via the restriction applied by the hydraulic members 246. Accordingly, the resistive force, or the degree to which the movement of the movable joint 328 and thereby the shaft 326 is restricted can be proportional to the hydraulic pressure of hydraulic members 348. This hydraulic pressure can be regulated, for instance, via the hydraulic fluid delivered to the hydraulic members 348 by a knob 358 and flow valves (e.g., the flow valves 160), as described herein.

Though not depicted in FIGS. 12A-12B and 13A-13B, the resistance mechanism 332 can also include all and/or any combination of components of the resistance mechanism 148 and resistance mechanism 238, including one or more flow valves, pressure transducers, hoses, and processor boards, which are generally indicated at 360. One or more of the listed components can, for example, be positioned and/or mounted within the first adjustment member 318 or second adjustment member 320, and/or be coupled to the movable joint 328 or resistance mechanism 332. Any processor board included in the shoulder strengthening system 300 can also be in wireless communication with one or more local or network processing environments (e.g., personal computer (s), mobile device(s), handheld device(s), etc.), web-based applications, and/or cloud computing environments, such that the data from the measurements from the transducers, rotational sensors, and/or data from a processor board can be viewed in real time and/or post measurement. In such instances and in some examples, the flow of the hydraulic fluid can also be adjusted via a web-based application and/or a processor and/or computing environment.

One advantage of the shoulder strengthening system 300, is that the entirety of the resistance system 302 can also be angled relative to the adjustment mechanism 310. As shown in FIG. 13B, for instance, the first bracket 336 can be pivotably coupled to the second adjustment member 320 of the adjustment mechanism 310 such that the resistance system 302 can be positioned relative to the adjustment mechanism 310 at various angles. Specifically, the first bracket 336 can be hinged to the second adjustment member 320 and configured to disengage and engage one of a plurality of openings 362 along the upper portion of the second adjustment member 320. The openings 362 can allow for incremental angle adjustments of the movable joint 328 and resistance mechanism 332 relative to the adjustment mechanism 310. For example, the movable joint 328 and resistance mechanism 332 of the resistance system 302 can be tilted at a downward slope toward the platform 306 and base 308 from the position of the joint 328 and mechanism 332 depicted in FIGS. 9A-13B. As generally indicated by the arrows 364 of FIG. 10B, in particular, the resistance system 302 can be angled relative the adjustment mechanism 310 such that the movable joint 328 and resistance mechanism 332 can form an angle relative to the adjustment mechanism 310 ranging from approximately 90 degrees (e.g., FIGS. 9A-13B) to approximately 60 degrees when at a downward slope. In some examples, the configuration of the second adjustment member 320 and first bracket 336 can be in such a way that the movable joint 328 and resistance mechanism 332 can be adjusted to form an angle less than 60 degrees relative to the adjustment mechanism 310 and/or greater than 90 degrees relative to the adjustment mechanism 310, such as to tilt the resistance system 302 at an upward slope.

Configured in this way, the shaft 326, movable joint 328, and resistance mechanism 332 can be said to pivot relative to the frame 304 about a third pivot axis A3 of the resistance system 302. The third pivot axis A3 being formed by the hinge or other suitable connection between the first bracket 336 and the second adjustment member 320 which permits the first bracket 336 to pivot relative to the second adjustment member 320 and adjustment mechanism 310. This third pivot axis A3 can also be used to position the resistance system 302 at a sloped, downward angle suitable for particular arm and shoulder movements. As an example, the movable joint 328 can be tilted at a downward slope such that the shaft 326 and wrist-ring structure 330 can be positioned and maneuvered as to allow a user to replicate particular body movements. A user, for instance, can position themselves in a standing position on the platform 306, with their back and/or side directed toward the adjustment mechanism 310. In this position, the user can secure their hand and/or wrist within the wrist-ring structure 330 and engage in overhand, sidearm, and/or underhand pitching motions. This configuration is desirable, for example, for diagnosing the extent of a pitcher's shoulder injury and/or monitoring the health of the pitcher's shoulder through movement which reproduces a natural pitching motion. The same or similar orientations of the resistance system 302 can be used for other athletic and/or occupational movements.

As shown in FIGS. 9A-13B, a lever 366 coupled to the first bracket 336 and/or second adjustment member 320 can be configured to engage and disengage one or more pins (and/or other fasteners) with the openings 362 and/or another portion of the second adjustment member 320. In some examples, the openings 362 need not be a plurality of openings but can be a single curved opening which tracks the possible motion of the first bracket 336 about the third axis A3.

The shaft 326 and wrist-ring structure 330 shown in FIGS. 9A-13B, can be structurally and functionally similar to the shaft 132 and wrist-ring structure 146 described herein (FIGS. 1-8D). For instance, as illustrated in FIGS. 11-13B, the shaft 326 can include an outer, first member 368 and an inner, second member 370 slidably coupled to the first member 368, as generally indicated by arrows 374 (FIGS. 10B and 13A). The first member 368 can be coupled to the movable joint 328 (FIGS. 13A-13B) and the upper end of the second member 370 coupled to the wrist-ring structure 330. In some examples, the shaft 326 can include a third member moveably coupled to and situated between the first member 368 and second member 370. The shaft 326 can also include a bi-directional spring and/or cables to provide smooth and adjustable resistance to the telescoping motion of the shaft 326, such as in lieu or in addition to the adjustable resistance provided by an adjustment ring (e.g., adjustment ring 186).

The wrist-ring structure 330 can be structurally and functionally similar as wrist-ring structure 146 described herein, such that the wrist-ring structure 330 can also be configured to brace the wrist and thereby the arm and hand of a user, permitting the wrist to rotate and pivot about multiple axes (e.g., FIGS. 7A-7B). The wrist-ring structure 330 can also be configured to restrict or limit certain wrist movement, such as when wrist or arm movement is undesirable for a given exercise. The shaft 326 and wrist-ring structure 330, as described, are also capable of multidirectional movement relative to the adjustment mechanism 310, base 308, and platform 306 via operation of the movable joint 328.

One difference between the wrist-ring structure 146 and the wrist-ring structure 330, however, is that the brace 206 has been replaced by a ball 372, or a portion thereof. As shown in FIGS. 11-13B for instance, the ball 372 can replicate the size, shape, and seams of a baseball, such as to further assist the user to reproduce the natural motion of pitching. In other examples, however, the ball 372 can replicate any other type of athletic equipment, such as a football or handle (e.g., of a racket or club), as just a couple of examples. The ball 372 can also be replaced with other objects which replicate other occupational tools.

In some examples, the ball 372 can be removably coupled to the shuttle of the wrist-ring structure 330 (e.g., shuttle 204) and/or be integrated with the shuttle. As such, the ball 372 can be interchangeable with one or more other braces (e.g., brace 206 or brace 234) and/or the wrist-ring structure 330 can be interchangeable with one or more other wrist-ring structures (e.g., wrist-ring structure 146). In other examples, the ball 372 can be independent of the shuttle or other components of the wrist-ring structure and be coupled directly to the shaft 326.

It should be appreciated that the shoulder strengthening system 100 and shoulder strengthening system 300 can include all and/or any combination of components described in reference to the other. As an example, in some examples, the shoulder strengthening system 100 can include the resistance system 302, such that shoulder strengthening system 100 includes the movable joint 328, resistance mechanism 332, and shaft 326 as described herein.

Although the resistance systems described herein can include hydraulic mechanisms to provide resistance, it should be appreciated that the materials making up the individual components of the resistance systems can also provide adequate resistance without a resistive force applied by the hydraulic mechanisms. For instance, in some cases, the weight and rigidity of the components of the resistance system 102 and resistance system 302 can provide ample resistance, particularly to those users just beginning rehabilitation. For this reason, one or more of the components of the resistance systems can be constructed of relatively light weight materials so as to ensure the components are able to be manipulated by a user whose shoulder is in a weakened state and vulnerable to reinjury. As one example, the members of shaft 132 and shaft 326 can be made of a lightweight, anodized aluminum which provides little weight to the resistance system.

Additional Examples of the Disclosed Technology

In view of the above-described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1: An exercise apparatus comprising: a frame; a joint pivotably coupled to the frame; a resistance mechanism coupled to the joint; a shaft coupled to the joint; and a wrist-ring structure coupled to the shaft, wherein the shaft, the wrist-ring structure, and the joint move together relative to the frame, and wherein the resistance mechanism is configured to restrict movement of the joint relative to the frame.

Example 2: The apparatus of any example herein, particularly example 1, wherein the resistance mechanism comprises a first hydraulic member and a second hydraulic member, the first hydraulic member configured to restrict relative motion of the joint about a first axis and the second hydraulic member configured to restrict relative motion of the joint about a second axis.

Example 3: The apparatus of any example herein, particularly any one of examples 1-2, wherein the joint is a universal joint, the universal joint having a first pivot axis and a second pivot axis perpendicular to the first pivot axis.

Example 4: The apparatus of any example herein, particularly any one of examples 2-3, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 5: The apparatus of any example herein, particularly any one of examples 1-4, wherein the shaft is a telescoping shaft assembly comprising a first member coupled to the joint and a second member coaxially aligned with and slidably coupled to the first member.

Example 6: The apparatus of any example herein, particularly example 5, wherein the telescoping shaft assembly further comprises an adjustment ring coupled to the first member and the second member and configured to restrict relative movement between the first member and the second member.

Example 7: The apparatus of any example herein, particularly example 6, wherein the first member comprises a plurality of leaf springs, and wherein the adjustment ring is coaxially aligned with and extending over the leaf springs.

Example 8: The apparatus of any example herein, particularly example 7, wherein rotation of the adjustment ring relative to the first member produces relative axial motion between the adjustment ring and both the leaf springs and the first member such that the leaf springs contact and apply a resistive force to the second member.

Example 9: The apparatus of any example herein, particularly example 8, wherein the relative resistive force applied to second member is proportional to the axial travel of the adjustment ring relative to the first member.

Example 10: The apparatus of any example herein, particularly any one of examples 8-9, wherein the first member comprises one or more sensors configured to measure the resistive force applied to the second member.

Example 11: The apparatus of any example herein, particularly any one of examples 5-10, wherein the first member comprises one or more sensors configured to track the position of the second member relative to the first member.

Example 12: The apparatus of any example herein, particularly any one of examples 1-11, wherein the wrist-ring structure comprises a ring, a shuttle movably coupled to the ring, and a brace coupled to the shuttle, the shuttle and brace configured to move along a circumference of the ring and about a first axis of the wrist-ring structure.

Example 13: The apparatus of any example herein, particularly example 12, wherein the ring is configured to pivot about a second axis of the wrist-ring structure such that the shuttle and brace also pivot about the second axis.

Example 14: The apparatus of any example herein, particularly example 13, wherein the ring, shuttle, and brace rotate about a third axis of the wrist-ring structure.

Example 15: The apparatus of any example herein, particularly any one of examples 1-14, the apparatus further comprising a support coupled to the frame and configured to abut an arm of a user of the apparatus.

Example 16: The apparatus of any example herein, particularly example 15, wherein the support is rotatably coupled to the frame such that the support is configured to rotate 360 degrees about a vertical axis of the frame.

Example 17: The apparatus of any example herein, particularly any one of examples 15-16, wherein the support comprises a telescoping shaft comprising a first member and a second member coaxially aligned with and slidably coupled to the first member.

Example 18: The apparatus of any example herein, particularly any one of examples 1-17, wherein the joint is rotatably coupled to the frame such that joint is configured to rotate 360 degrees about a vertical axis of the frame.

Example 19: The apparatus of any example herein, particularly example 18, wherein the shaft and the wrist-ring structure are configured to move in multiple directions relative to the frame.

Example 20: The apparatus of any example herein, particularly any one of examples 1-19, wherein the joint comprises a base coupled to the frame and a movable component pivotably coupled to the base.

Example 21: The apparatus of any example herein, particularly example 20, wherein the joint is coupled to the frame by an adjustable arm such that the relative distance between the joint and the frame can be increased and decreased.

Example 22: An exercise apparatus comprising: a frame; a joint pivotably coupled to the frame; a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; a shaft coupled to the joint; and a wrist-ring structure coupled to the shaft, wherein the shaft, the wrist-ring structure, and the joint are configured to move together relative to the frame about the first and second axes.

Example 23: The apparatus of any example herein, particularly example 22, wherein the first hydraulic member and the second hydraulic member are hydraulic cylinders.

Example 24: The apparatus of any example herein, particularly example 22, wherein the first hydraulic member and the second hydraulic member are hydraulic gear assemblies.

Example 25: The apparatus of any example herein, particularly any one of examples 22-24, wherein the first hydraulic member and the second hydraulic member are coupled to one or more flow valves configured to increase and/or decrease a flow rate of hydraulic fluid delivered to the first and second hydraulic members.

Example 26: The apparatus of any example herein, particularly example 25, wherein the flow rate of hydraulic fluid modifies the degree in which the relative motion of the joint is restricted by the first hydraulic member and the second hydraulic member.

Example 27: The apparatus of any example herein, particularly any one of examples 25-26, wherein the degree in which the relative motion of the joint is restricted is directly proportional to the flow rate of hydraulic fluid delivered to the first and second hydraulic members.

Example 28: The apparatus of any example herein, particularly any one of examples 22-27, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 29: The apparatus of any example herein, particularly any one of examples 22-28, wherein the joint is a universal joint, the universal joint having a first pivot axis and a second pivot axis perpendicular to the first pivot axis.

Example 30: The apparatus of any example herein, particularly any one of examples 22-29, wherein the first hydraulic member is aligned with the first pivot axis and the second hydraulic member is aligned with the second pivot axis.

Example 31: The apparatus of any example herein, particularly any one of examples 22-30, wherein the first hydraulic member and the second hydraulic member form a 90-degree angle relative to one another.

Example 32: An exercise apparatus comprising: a frame; a joint pivotably coupled to the frame; a resistance mechanism coupled to the joint; a shaft assembly coupled to the joint, the shaft assembly comprising a first member and a second member coaxially aligned with and slidably coupled to the first member; and a wrist-ring structure coupled to the shaft assembly, wherein the shaft assembly, the wrist-ring structure, and the joint move together relative to the frame, and wherein the resistance mechanism is configured to restrict movement of the joint relative to the frame.

Example 33: The apparatus of any example herein, particularly example 32, wherein first member is coupled to the joint and the wrist-ring structure is coupled to the second member.

Example 34: The apparatus of any example herein, particularly example 32, wherein the second member is coupled to the joint and the wrist-ring structure is coupled to the first member.

Example 35: The apparatus of any example herein, particularly any one of examples 32-34, wherein one of the first member and the second member has a diameter less than a diameter of the other of the first member and second member.

Example 36: The apparatus of any example herein, particularly any one of examples 30-35, wherein the shaft assembly further comprises an adjustment mechanism rotatably coupled to the first member and the second member and configured to restrict relative movement between the first member and the second member.

Example 37: The apparatus of any example herein, particularly example 36, wherein one of the first member and the second member comprises a plurality of leaf springs, and wherein the adjustment mechanism is coaxially aligned with and extending over the leaf springs.

Example 38: The apparatus of any example herein, particularly any one of examples 36-37, wherein rotation of the adjustment mechanism relative to the first member and the second member produces relative axial motion between the adjustment mechanism and the leaf springs such that the leaf springs contact and apply a frictional force to one of the first member and the second member.

Example 39: The apparatus of any example herein, particularly example 38, wherein the relative frictional force applied to one of the first member and the second member is proportional to the axial travel of the adjustment mechanism relative to the leaf springs.

Example 40: The apparatus of any example herein, particularly any one of examples 38-39, wherein one of the first member and the second member comprises one or more sensors configured to measure the frictional force applied to the other of the first member and the second member.

Example 41: The apparatus of any example herein, particularly any one of examples 32-40, wherein one of the first member and the second member comprises one or more sensors configured to track the position of the second member relative to the first member.

Example 42: An exercise apparatus comprising: a frame; a joint pivotably coupled to the frame; a resistance mechanism coupled to the joint; a shaft coupled to the joint; and a wrist-ring structure coupled to the shaft and comprising a ring, a shuttle movably coupled to the ring, and a brace coupled to the shuttle, the shuttle and brace configured to move along a circumference of the ring and about a first axis of the wrist-ring structure, wherein the shaft, the wrist-ring structure, and the joint move together relative to the frame, and wherein the resistance mechanism is configured to restrict movement of the joint relative to the frame.

Example 43: The apparatus of any example herein, particularly example 42, wherein the ring is configured to pivot about a second axis of the wrist-ring structure such that the shuttle and brace also pivot about the second axis.

Example 44: The apparatus of any example herein, particularly example 43, wherein the ring, shuttle, and brace rotate about a third axis of the wrist-ring structure.

Example 45: The apparatus of any example herein, particularly any one of examples 42-44, wherein the wrist-ring structure comprises a lever configured to control the relative movement of the shuttle and brace along the circumference of the ring.

Example 46: The apparatus of any example herein, particularly example 45, wherein the lever is configured to switch the brace and shuttle between a fixed state and a free rotation state.

Example 47: The apparatus of any example herein, particularly example 46, wherein the lever is configured to switch the brace and shuttle between a fixed state and a momentarily free rotation state.

Example 48: The apparatus of any example herein, particularly example 45, wherein the lever in a first position is configured to fix the relative position of the brace and shuttle along the circumference of the ring.

Example 49: The apparatus of any example herein, particularly example 48, wherein the lever in a second position is configured to allow the brace and shuttle to move freely along the circumference of the ring.

Example 50: The apparatus of any example herein, particularly example 49, wherein the lever is configured to move between the first position and a third position such that the brace and shuttle are momentarily free to move along the circumference of the ring when the lever is in a third position and fixed when the lever is in the first position.

Example 51: The apparatus of any example herein, particularly any one of examples 42-50, wherein the wrist-ring structure is coupled to a release mechanism and the release mechanism is coupled to the shaft.

Example 52: An exercise apparatus comprising: a frame; a joint moveably coupled to the frame; a resistance mechanism coupled to the joint; a shaft coupled to the joint; and a wrist-ring structure coupled to the shaft, wherein the shaft, the wrist-ring structure, and the joint move together relative to the frame about first, second, and third axes, and wherein the resistance mechanism is configured to restrict movement of the joint relative to the frame.

Example 53: The apparatus of any example herein, particularly example 52, further comprising a platform moveably coupled to the frame.

Example 54: The apparatus of any example herein, particularly example 53, wherein when the platform is in a first orientation the apparatus is in a stowable state and wherein when the platform is in a second orientation the apparatus is in an operational state.

Example 55: The apparatus of any example herein, particularly any one of examples 52-54, wherein a vertical positioning of the shaft, the wrist-ring structure, and the joint relative to the frame is adjustable via an adjustment mechanism.

Example 56: The apparatus of any example herein, particularly any one of examples 52-55, wherein the frame comprises a first adjustment member and a second adjustment member moveably coupled to the first adjustment member and the joint, the second adjustment member being configured to move axially relative to the first adjustment member.

Example 57: The apparatus of any example herein, particularly any one of examples 52-56, wherein the wrist-ring structure comprises a ring, a shuttle movably coupled to the ring, and a ball portion coupled to the shuttle, the shuttle and ball portion configured to move along a circumference of the ring and about a first axis of the wrist-ring structure.

Example 58: The apparatus of any example herein, particularly any one of examples 57, wherein the ring is configured to pivot about a second axis of the wrist-ring structure such that the shuttle and ball portion also pivot about the second axis.

Example 59: The apparatus of any example herein, particularly example 58, wherein the ring, shuttle, and ball portion rotate about a third axis of the wrist-ring structure.

Example 60: An exercise apparatus comprising: a frame; a joint pivotably coupled to the frame; a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; and a shaft coupled to the joint, wherein the shaft and the joint are configured to move together relative to the frame about the first and second axes.

Example 61: The apparatus of any example herein, particularly example 60, wherein the first hydraulic member and the second hydraulic member are coupled to one or more flow valves configured to increase and/or decrease a flow rate of hydraulic fluid delivered to the first and second hydraulic members.

Example 62: The apparatus of any example herein, particularly any one of examples 60-61, wherein the flow rate of hydraulic fluid modifies the degree in which the relative motion of the joint is restricted by the first hydraulic member and the second hydraulic member.

Example 63: The apparatus of any example herein, particularly any one of examples 60-62, wherein the degree in which the relative motion of the joint is restricted is directly proportional to the flow rate of hydraulic fluid delivered to the first and second hydraulic members.

Example 64: The apparatus of any example herein, particularly any one of examples 60-63, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 65: The apparatus of any example herein, particularly any one of examples 60-64, wherein the joint is a universal joint, the universal joint having a first pivot axis and a second pivot axis perpendicular to the first pivot axis.

Example 66: The apparatus of any example herein, particularly any one of examples 60-65, further comprising a wrist-ring structure coupled to the shaft, wherein the wrist-ring structure moves with the shaft and joint about the first and second axes.

Example 67: The apparatus of any example herein, particularly example 66, wherein the wrist-ring structure comprises a ring, a shuttle movably coupled to the ring, and a brace coupled to the shuttle, the shuttle and brace configured to move along a circumference of the ring and about a first axis of the wrist-ring structure.

Example 68: The apparatus of any example herein, particularly example 67, wherein the ring is configured to pivot about a second axis of the wrist-ring structure such that the shuttle and brace also pivot about the second axis.

Example 69: The apparatus of any example herein, particularly example 68, wherein the ring, shuttle, and brace rotate about a third axis of the wrist-ring structure.

Example 70: The apparatus of any example herein, particularly any one of examples 60-69, wherein the shaft is a telescoping shaft assembly comprising at least a first member coupled to the joint and a second member coaxially aligned with and slidably coupled to the first member.

Example 71: The apparatus of any example herein, particularly any one of examples 60-70, wherein the telescoping shaft assembly further comprises an adjustment mechanism configured to restrict relative movement between the first member and the second member.

Example 72: The apparatus of any example herein, particularly any one of examples 60-71, further comprising a support coupled to the frame and configured to abut an arm of a user of the apparatus.

Example 73: The apparatus of any example herein, particularly example 72, wherein the support is rotatably coupled to the frame such that the support is configured to rotate 360 degrees about a vertical axis of the frame.

Example 74: The apparatus of any example herein, particularly any one of examples 60-73, wherein the shaft and the joint move together relative to the frame about a third axes.

In view of the many possible embodiments to which the principles of the disclosed technology may be applied, it should be recognized that the illustrated embodiments are only examples of the technology and should not be taken as limiting the scope of the technology. Rather, the scope of the technology is defined by the following claims and their equivalents.

The invention claimed is:

1. An exercise apparatus comprising:

a frame;

a joint pivotably coupled to the frame;

a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; and a shaft coupled to the joint, wherein the shaft and the joint are configured to move together relative to the frame about the first and second axes; and wherein the shaft and the joint move together relative to the frame about a third axis.

2. The apparatus of claim 1, wherein the first hydraulic member and the second hydraulic member are coupled to one or more flow valves configured to increase and/or decrease a flow rate of hydraulic fluid delivered to the first and second hydraulic members.

3. The apparatus of claim 2, wherein the flow rate of hydraulic fluid modifies the degree in which the relative motion of the joint is restricted by the first hydraulic member and the second hydraulic member.

4. The apparatus of claim 2, wherein the degree in which the relative motion of the joint is restricted is directly proportional to the flow rate of hydraulic fluid delivered to the first and second hydraulic members.

5. The apparatus of claim 1, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

6. The apparatus of claim 1, wherein the joint is a universal joint, the universal joint having a first pivot axis and a second pivot axis perpendicular to the first pivot axis.

7. The apparatus of claim 1, further comprising a wrist-ring structure coupled to the shaft, wherein the wrist-ring structure moves with the shaft and joint about the first and second axes.

8. The apparatus of claim 7, wherein the wrist-ring structure comprises a ring, a shuttle movably coupled to the ring, and a brace coupled to the shuttle, the shuttle and brace configured to move along a circumference of the ring and about a first axis of the wrist-ring structure.

9. The apparatus of claim 8, wherein the ring is configured to pivot about a second axis of the wrist-ring structure such that the shuttle and brace also pivot about the second axis.

10. The apparatus of claim 9, wherein the ring, shuttle, and brace rotate about a third axis of the wrist-ring structure.

11. The apparatus of claim 1, wherein the shaft is a telescoping shaft assembly comprising at least a first member coupled to the joint and a second member coaxially aligned with and slidably coupled to the first member.

12. The apparatus of claim 11, wherein the telescoping shaft assembly further comprises an adjustment mechanism configured to restrict relative movement between the first member and the second member.

13. The apparatus of claim 1, further comprising a support coupled to the frame and configured to abut an arm of a user of the apparatus.

14. The apparatus of claim 13, wherein the support is rotatably coupled to the frame such that the support is configured to rotate 360 degrees about a vertical axis of the frame.

15. An exercise apparatus comprising:

a frame;

a joint pivotably coupled to the frame;

a resistance mechanism coupled to the joint;

a shaft coupled to the joint;

a wrist-ring structure coupled to the shaft, wherein the resistance mechanism is configured to restrict movement of the joint relative to the frame; and an outwardly extending arm coupled to the resistance system, wherein the outwardly extending arm is hinged to the post and is configured to rotate clockwise and counterclockwise relative to the frame about an axis of the post such that the shaft, the wrist-ring structure, the resistance mechanism, and the joint move together about the axis of the post relative to the frame.

16. The apparatus of claim 15, wherein the wrist-ring structure comprises a ring, a shuttle movably coupled to the ring, and a brace coupled to the shuttle, the shuttle and brace configured to move along a circumference of the ring and about a first axis of the wrist-ring structure.

17. The apparatus of claim 16, wherein the ring is configured to pivot about a second axis of the wrist-ring structure such that the shuttle and brace also pivot about the second axis.

18. The apparatus of claim 17, wherein the ring, shuttle, and brace are rotatable about a third axis of the wrist-ring structure.

19. The apparatus of claim 18, wherein the apparatus further comprising a support coupled to the frame and configured to abut an arm of a user of the apparatus, and wherein the support comprises a telescoping shaft and is rotatably coupled to the frame such that the support is configured to rotate 360 degrees about a vertical axis of the frame.

20. An exercise apparatus comprising:

a frame comprising a post;

a resistance system comprising:

a joint;

a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; and a shaft coupled to the joint; and an outwardly extending arm coupled to the resistance system;

wherein the shaft and the joint are configured to move together relative to the frame about the first and second axes;

wherein the outwardly extending arm is hinged to the post and is configured to rotate clockwise and counterclockwise relative to the frame about a third axis.

* * * * *